US009671729B2

(12) United States Patent
Yoshimura

(10) Patent No.: US 9,671,729 B2
(45) Date of Patent: Jun. 6, 2017

(54) HEATER, IMAGE HEATING APPARATUS INCLUDING THE HEATER AND MANUFACTURING METHOD OF THE HEATER

(71) Applicant: CANON KABUSHIKI KAISHA, Tokyo (JP)

(72) Inventor: Tomohiko Yoshimura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/844,387

(22) Filed: Sep. 3, 2015

(65) Prior Publication Data

US 2016/0070217 A1 Mar. 10, 2016

(30) Foreign Application Priority Data

Sep. 9, 2014 (JP) ..... 2014-183709

(51) Int. Cl.
*G03G 15/20* (2006.01)

(52) U.S. Cl.
CPC ..... *G03G 15/2053* (2013.01); *G03G 15/2042* (2013.01); *G03G 2215/2035* (2013.01)

(58) Field of Classification Search
None
See application file for complete search history.

(56) References Cited

U.S. PATENT DOCUMENTS 2,758,256 A 8/1956 Eisler
5,285,049 A 2/1994 Fukumoto et al.
6,084,208 A * 7/2000 Okuda ..... G03G 15/2064 219/216

(Continued)

FOREIGN PATENT DOCUMENTS

JP 54-15335 U 1/1979
JP 6-250539 A 9/1994

(Continued)

OTHER PUBLICATIONS

Communication issued in counterpart EP Patent Application No. 15182299.6 dated Mar. 1, 2016.

(Continued)

*Primary Examiner* — David M Gray
*Assistant Examiner* — Thomas Giampaolo, II
(74) *Attorney, Agent, or Firm* — Fitzpatrick, Cella, Harper & Scinto

(57) ABSTRACT

A heater includes: a substrate; and a plurality of electrode portions including first electrode portions electrically connectable with the first terminal and second electrode portions electrically connectable with the second terminal. The first electrode portion and the second electrode portion are arranged alternately with predetermined gaps in a longitudinal direction of the substrate. The heater also includes a plurality of heat generating portions provided between adjacent ones of the electrode portions so as to electrically connect between adjacent electrode portions. The heat generating portions are capable of generating heat by the electric power supply between adjacent electrode portions. With respect to a widthwise direction of the substrate, the distance between ends of the adjacent electrode portions is larger than the width of the plurality of heat generating portions.

12 Claims, 13 Drawing Sheets

(56) References Cited

U.S. PATENT DOCUMENTS

| | | | | |
|---|---|---|---|---|
| 7,203,438 | B2 | 4/2007 | Omata et al. | |
| 8,971,735 | B2 | 3/2015 | Yoshimura | |
| 2005/0163523 | A1* | 7/2005 | Omata | G03G 15/2042 399/69 |
| 2012/0201582 | A1 | 8/2012 | Shimura et al. | |
| 2014/0318931 | A1 | 10/2014 | Takematsu et al. | |

FOREIGN PATENT DOCUMENTS

| | | | |
|---|---|---|---|
| JP | 10-302934 | A | 11/1998 |
| JP | 2005-234540 | A | 9/2005 |
| JP | 2012-37613 | A | 2/2012 |
| RU | 2306588 | C2 | 9/2007 |

OTHER PUBLICATIONS

Russian Decision to Grant issued in corresponding Rusian Application No. 2015135994/28(055111).

* cited by examiner

HEATER, IMAGE HEATING APPARATUS INCLUDING THE HEATER AND MANUFACTURING METHOD OF THE HEATER

FIELD OF THE INVENTION AND RELATED ART

The present invention relates to a heater for heating an image on a sheet, an image heating apparatus including the heater and a manufacturing method of the heater. The image heating apparatus is usable with an image forming apparatus such as a copying machine, a printer, a facsimile machine, a multifunction machine having a plurality of functions thereof, or the like.

An image forming apparatus is known in which a toner image is formed on the sheet and is fixed on the sheet by heat and pressure in a fixing device (image heating apparatus). As for such a fixing device, a type of fixing device has been proposed (Japanese Laid-open Patent Application (JP-A) Hei 6-250539) in which a heat generating element (heater) is contacted to an inner surface of a thin flexible belt to apply heat to the belt. Such a fixing device is advantageous in that the structure has a low thermal capacity, and therefore, the required temperature rise for performing a satisfactory fixing operation is quick.

JPA Hei 6-250539 discloses the structure of a heater including a plurality of electrodes arranged, in a longitudinal direction of a substrate, on a heat generating element (heat generating member) extending in the longitudinal direction. On this heater, the electrodes different in polarity are alternately arranged on the heat generating element, and therefore a current flows through the heat generating elements between adjacent electrodes. Specifically, the electrodes of one polarity are connected with electroconductive lines provided in one widthwise end side of the substrate relative to the heat generating element, and the electrodes of the other polarity are connected with electroconductive lines provided in the other widthwise end side of the substrate relative to the heat generating element. For this reason, when a voltage is applied between these electroconductive lines, the heat generating elements generates heat in an entire region thereof with respect to the longitudinal direction.

Incidentally, the manner of the heat generation of the heat is determined by the resistance of the heat generating element and a magnitude of a current flowing through the heat generating element. The resistance of the heat generating element is determined by the dimensions and a value resistivity of the heat generating element. In JP-A Hei 6-250539, the heater is caused to generate heat in a desired manner by adjusting the resistance of the heat generating element during energization to the heat generating element by a gap between the adjacent electrodes.

However, there was a risk that the heater disclosed in JP-A Hei 6-250539 causes a heat generation non-uniformity during the energization due to a structure in which the heat generating element and the electrode are laminated on the substrate. In JP-A Hei 6-250539, the heater is manufactured by forming each of the heat generating element and the electrode. In this way, in the case where the heat generating element and the electrode are formed on the substrate through the screen printing, the heat generating element and the electrode are formed in separate steps using separate plates. For that reason, depending on the alignment accuracy between the substrate and each of the plate, the positional relationship between the heat generating element and the electrode deviates from an ideal position relationship in some cases.

If printing deviates so that the length of the electrode to be connected with the heat generating element is shorter than the width of the heat generating element with respect to a widthwise direction, the heat generating element generates a region where no energization to the heat generating element is made. Particularly, in the case where each of the plates is designed so that the heat generating element width and the electrode length coincide with each other, the length of the electrode connected with the heat generating element becomes insufficient corresponding to the deviation of the positional relationship due to printing accuracy. In this case, the proportion of the non-energization region to the heat generating element becomes large, so that the heater causes heat a generation non-uniformity.

SUMMARY OF THE INVENTION

A principal object of the present invention is to provide a heater with a suppressed heat generation non-uniformity.

Another object of the present invention is to provide an image heating apparatus including a heater with a suppressed heat generation non-uniformity.

A further object of the present invention is to provide a manufacturing method of the heater with a suppressed heat generation non-uniformity.

According to an aspect of the present invention, there is provided a heater usable with an image heating apparatus including an electric energy supplying portion provided with a first terminal and a second terminal, and an endless belt for heating an image on a sheet. The heater is contactable to the belt to heat the belt. The heater comprises a: substrate; a plurality of electrode portions including first electrode portions electrically connectable with the first terminal and second electrode portions electrically connectable with the second terminal. The first electrode portion and the second electrode portion are arranged alternately with predetermined gaps in a longitudinal direction of the substrate. The apparatus also comprises a substrate; and a plurality of heat generating portions provided between adjacent ones of the electrode portions so as to electrically connect between adjacent electrode portions. The heat generating portions are capable of generating heat by the electric power supply between adjacent electrode portions. With respect to a widthwise direction of the substrate, the distance between ends of the adjacent electrode portions is larger than the width of the plurality of heat generating portions.

Further features of the present invention will become apparent from the following description of exemplary embodiments with reference to the attached drawings.

DESCRIPTION OF THE EMBODIMENTS

Embodiments of the present invention will be described in conjunction with the accompanying drawings. In this embodiment, the image forming apparatus is a laser beam printer using an electrophotographic process as an example. The laser beam printer will be simply called printer.

(Embodiment)

[Image Forming Portion]

Figure 1:
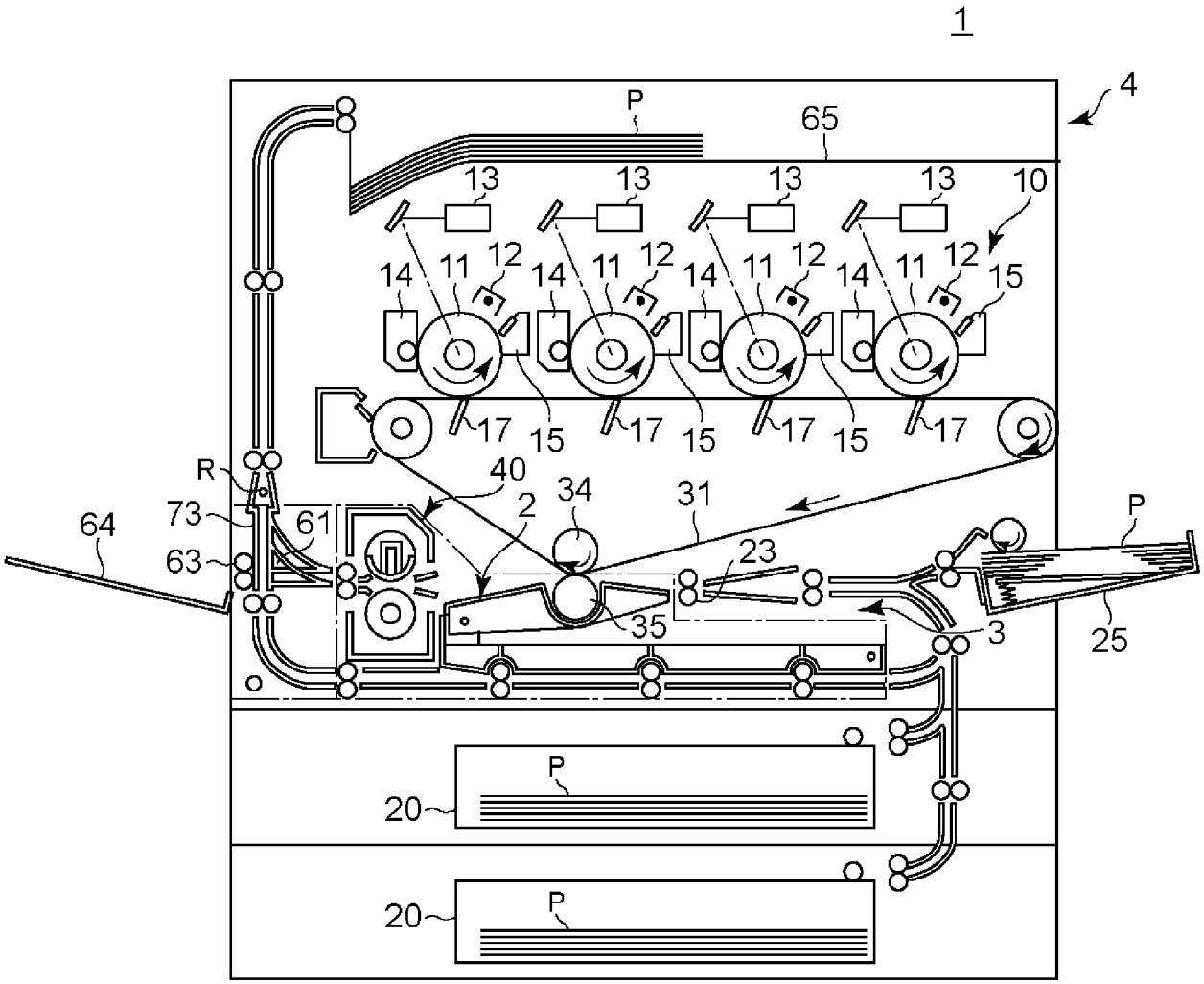
FIG. 1 is a sectional view of an image forming apparatus according to an embodiment of the present invention.

FIG. 1 is a sectional view of the printer 1 which is the image forming apparatus of this embodiment. The printer 1 comprises an image forming station 10 and a fixing device 40, in which a toner image formed on the photosensitive drum 11 is transferred onto a sheet P, and is fixed on the sheet P, by which an image is formed on the sheet P. Referring to FIG. 1, the structures of the apparatus will be described in detail.

As shown in FIG. 1, the printer 1 includes image forming stations 10 for forming respective color toner images Y (yellow), M (magenta), C (cyan) and Bk (black). The image forming stations 10 includes respective photosensitive drums 11 corresponding to Y, M, C, Bk colors are arranged in the order named from the left side. Around each drum 11, similar elements are provided as follows: a charger 12; an exposure device 13; a developing device 14; a primary transfer blade 17; and a cleaner 15. The structure for the Bk toner image formation will be described as a representative, and the descriptions for the other colors are omitted for simplicity by assigning the like reference numerals. So, the elements will be simply called the photosensitive drum 11, the charger 12, the exposure device 13, the developing device 14, the primary transfer blade 17 and the cleaner 15 with these reference numerals.

The photosensitive drum 11 as an electrophotographic photosensitive member is rotated by a driving source (unshown) in the direction indicated by an arrow (counterclockwise direction in FIG. 1). Around the photosensitive drum 11, the charger 12, the exposure device 13, the developing device 14, the primary transfer blade 17 and the cleaner 15 are provided in the order named.

A surface of the photosensitive drum 11 is electrically charged by the charger 12. Thereafter, the surface of the photosensitive drum 11 exposed to a laser beam in accordance with image information by the exposure device 13, so that an electrostatic latent image is formed. The electrostatic latent image is developed into a Bk toner image by the developing device 14. At this time, similar processes are carried out for the other colors. The toner image is transferred from the photosensitive drum 11 onto an intermediary transfer belt 31 by the primary transfer blade 17 sequentially (primary-transfer). The toner remaining on the photosensitive drum 11 after the primary-image transfer is removed by the cleaner 15. By this, the surface of the photosensitive drum 11 is cleaned so as to be prepared for the next image formation.

On the other hand, the sheet P contained in a feeding cassette 20 or placed on a multi-feeding tray 25 is picked up by a feeding mechanism (unshown) and fed to a pair of registration rollers 23. The sheet P is a member on which the image is formed. Specific examples of the sheet P are plain paper, thick sheets, resin material sheets, an overhead projector film or the like. The pair of registration rollers 23 once stops the sheet P for correcting oblique feeding. The registration rollers 23 then feed the sheet P into the space between the intermediary transfer belt 31 and the secondary transfer roller 35 in timed relation with the toner image on the intermediary transfer belt 31. The roller 35 functions to transfer the color toner images from the belt 31 onto the sheet P. Thereafter, the sheet P is fed into the fixing device (image heating apparatus) 40. The fixing device 40 applies heat and pressure to the toner image T on the sheet P to fix the toner image on the sheet P.

[Fixing Device]

Figure 2:
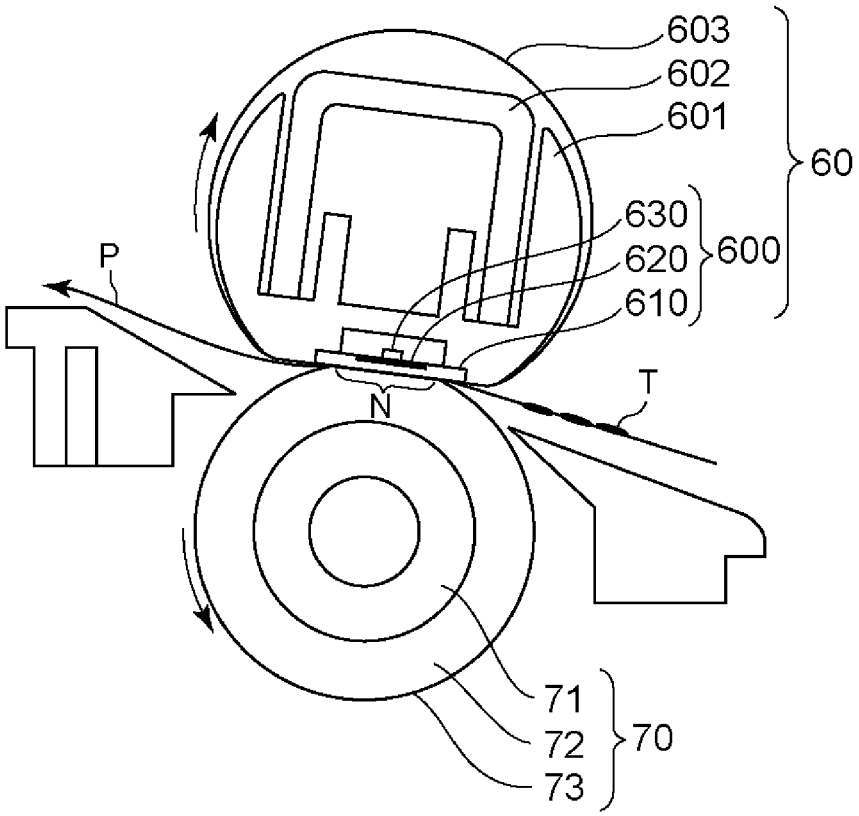
FIG. 2 is a sectional view of an image heating apparatus in the embodiment.
Figure 3:
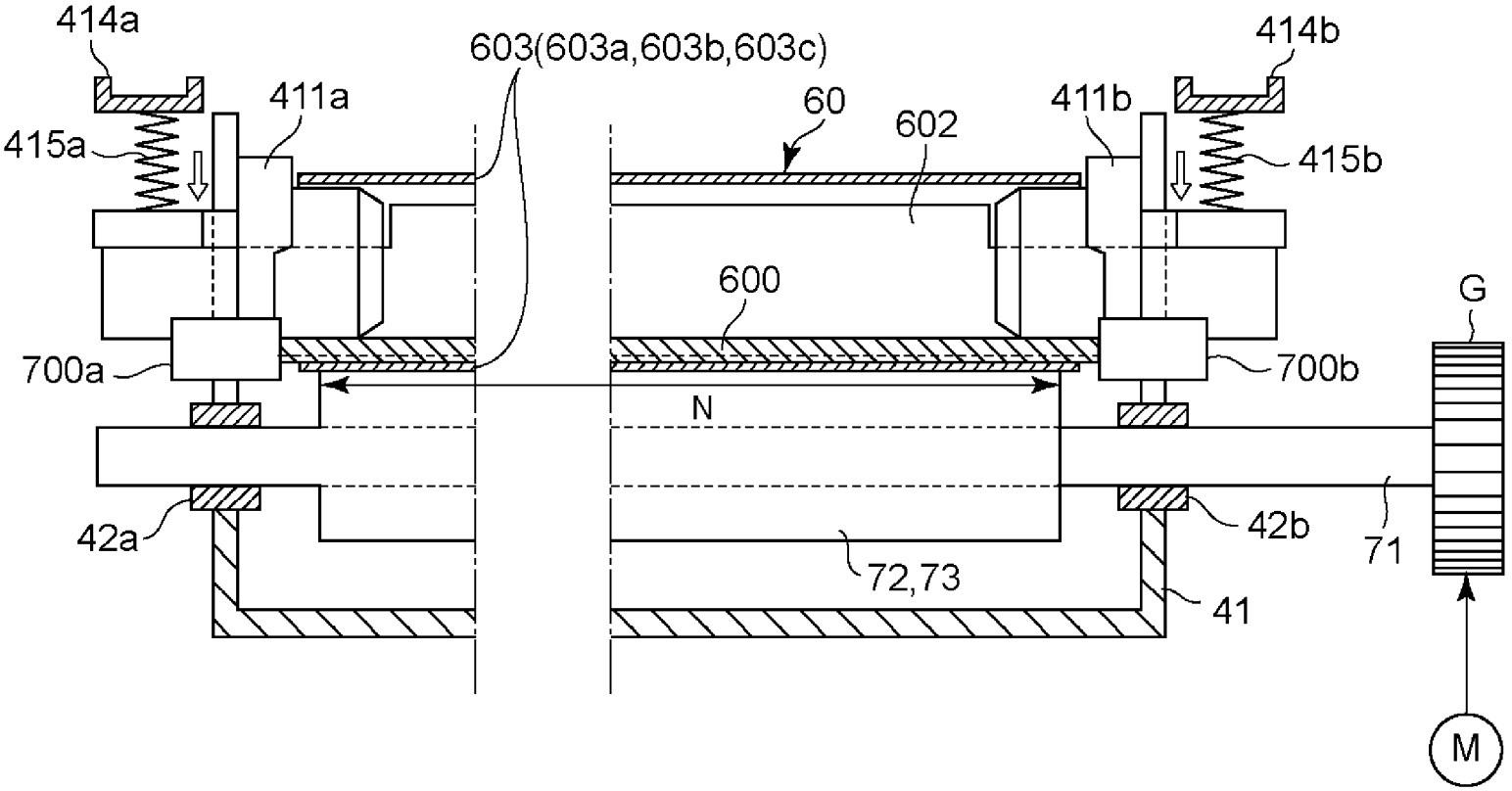
FIG. 3 is a front view of the image heating apparatus in the embodiment.
Figure 4:
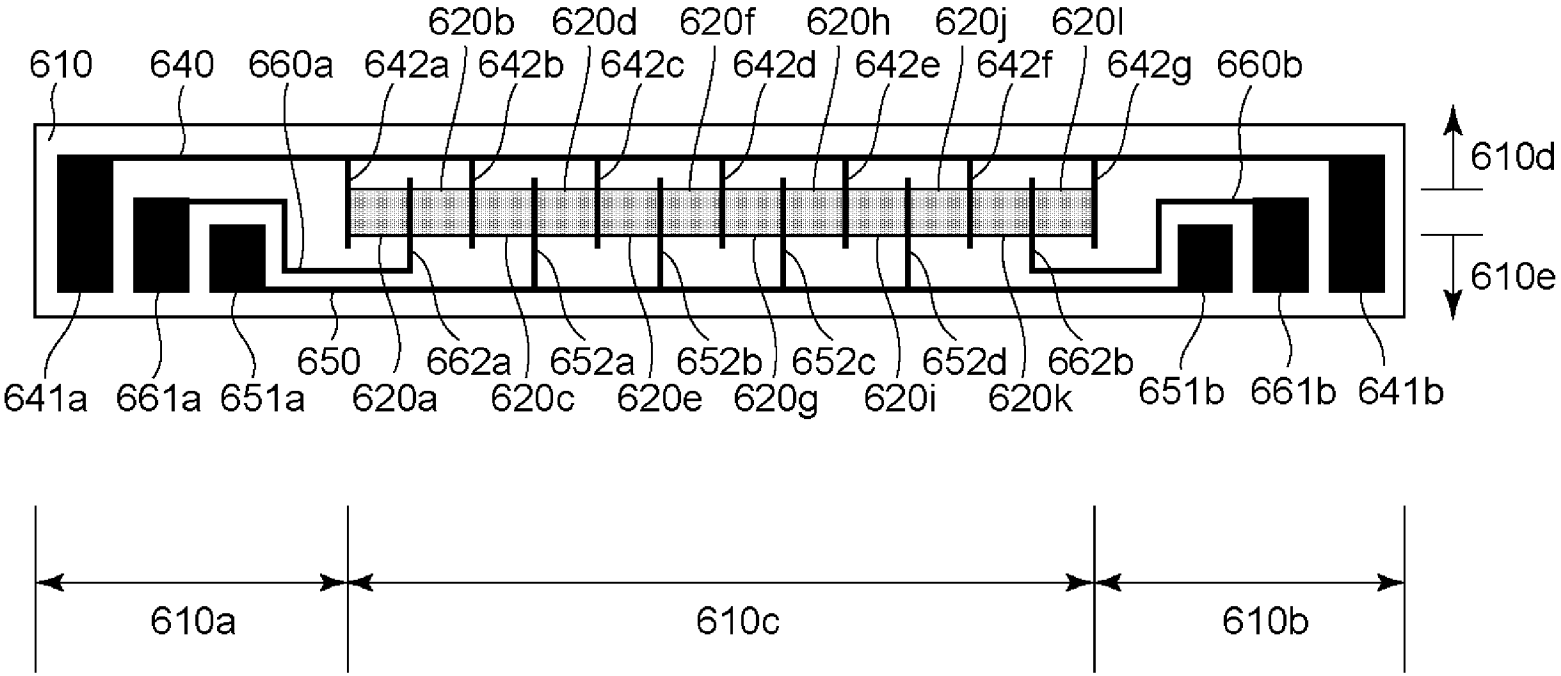
FIG. 4 illustrates a structure of a heater in the embodiment.
Figure 5:
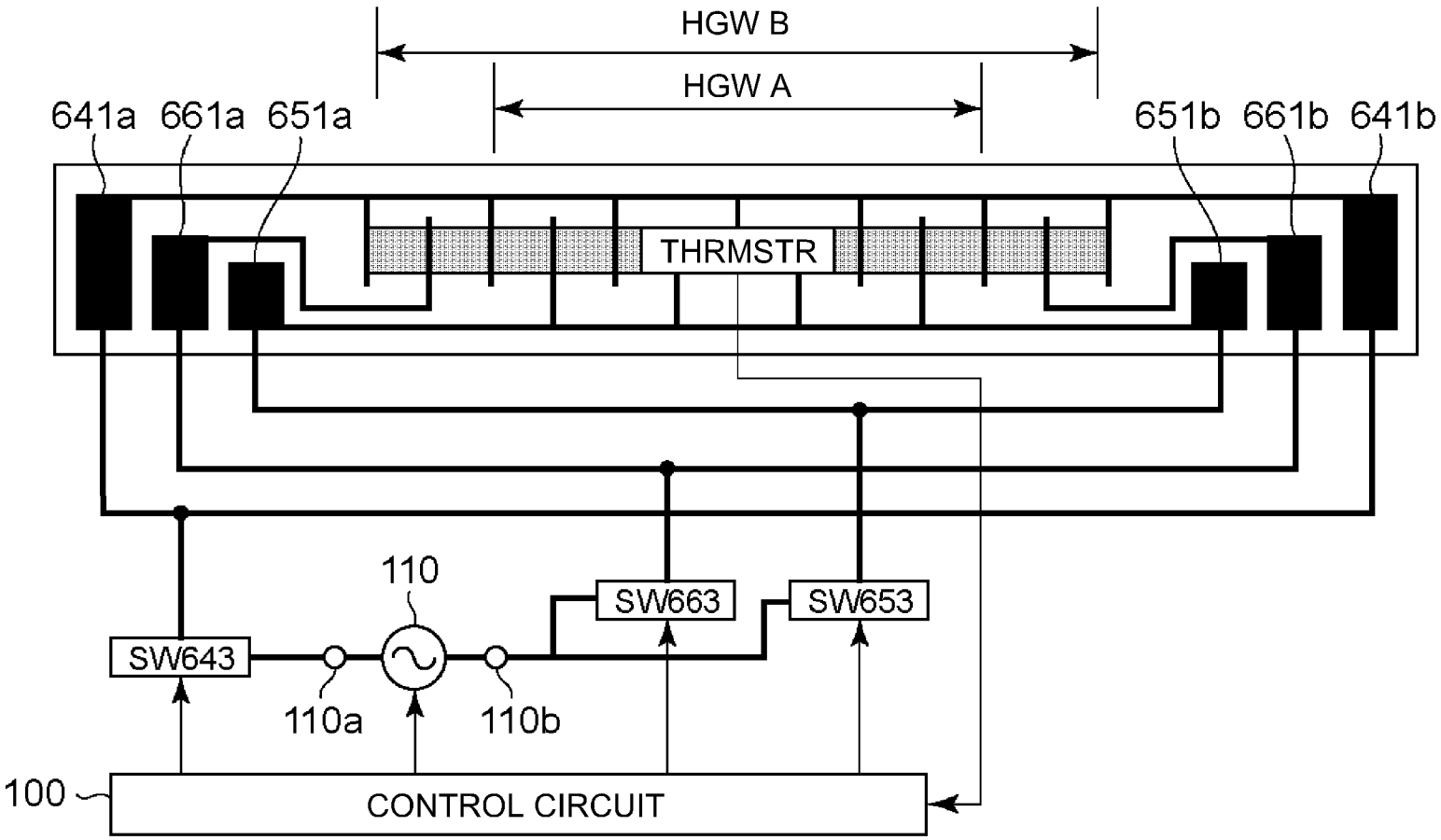
FIG. 5 illustrates a structural relationship of the image heating apparatus in the embodiment.

The fixing device 40 which is the image heating apparatus used in the printer 1 will be described. FIG. 2 is a sectional view of the fixing device 40. FIG. 3 is a front view of the fixing device 40. FIG. 4 illustrates a structure of a heater 600. FIG. 5 illustrates a structural relationship of the fixing device 40.

The fixing device 40 is an image heating apparatus for heating the image on the sheet by a heater unit 60 (unit 60). The unit 60 includes a flexible thin fixing belt 603 and the heater 600 contacted to the inner surface of the belt 603 to heat the belt 603 (low thermal capacity structure). Therefore, the belt 603 can be efficiently heated, so that a quick temperature rise at the start of the fixing operation is accomplished. As shown in FIG. 2, the belt 603 is nipped between the heater 600 and the pressing roller 70 (roller 70), by which a nip N is formed. The belt 603 rotates in the direction indicated by the arrow (clockwise in FIG. 2), and the roller 70 is rotated in the direction indicated by the arrow (counterclockwise in FIG. 2) to nip and feed the sheet P supplied to the nip N. At this time, the heat from the heater 600 is supplied to the sheet P through the belt 603, and therefore, the toner image T on the sheet P is heated and pressed by the nip N, so that the toner image it fixed on the sheet P by the heat and pressure. The sheet P having passed through the fixing nip N is separated from the belt 603 and is discharged. In this embodiment, the fixing process is carried out as described above. The structure of the fixing device 40 will be described in detail.

Unit 60 is a unit for heating and pressing an image on the sheet P. The longitudinal direction of the unit 60 is parallel with the longitudinal direction of the roller 70. The unit 60 comprises a heater 600, a heater holder 601, a support stay 602 and a belt 603.

The heater 600 is a plate-like heating member for heating the belt 603, slidably contacting the inner surface of the belt 603. The heater 600 is pressed to the inside surface of the belt 603 toward the roller 70 so as to provide a desired nip width of the nip N. The dimensions of the heater 600 in this embodiment are 5-20 mm in the width (the dimension as measured in the up-down direction in FIG. 4), 350-400 mm in the length (the dimension as measured in the left-right direction in FIG. 4), and 0.5-2 mm in the thickness. The heater 600 comprises a substrate 610 elongated in a direction perpendicular to the feeding direction of the sheet P (widthwise direction of the sheet P), and a heat generating resistor 620 (heat generating element 620) as a heat generating layer.

The heater 600 is fixed on the lower surface of the heater holder 601 along the longitudinal direction of the heater holder 601. In this embodiment, the heat generating element 620 is provided on the back side of the substrate 610 which is not in slidable contact with the belt 603, but the heat generating element 620 may be provided on the front surface of the substrate 610 that is in slidable contact with the belt 603. However, the heat generating element 620 of the heater 600 is preferably provided on the back side of the substrate 610, by which a uniform heating effect to the substrate 610 is accomplished, from the standpoint of preventing non-uniform heat application to the belt 603. The details of the heater 600 will be described hereinafter.

The belt 603 is a cylindrical (endless) belt(film) for heating the image on the sheet in the nip N. The belt 603 comprises a base material 603*a*, an elastic layer 603*b* thereon, and a parting layer 603*c* on the elastic layer 603*b*, for example. The base material 603*a* may be made of metal material, such as stainless steel or nickel, or a heat resistive resin material, such as polyimide. The elastic layer 603*b* may be made of an elastic and heat resistive material, such as a silicone rubber or a fluorine-containing rubber. The parting layer 603*c* may be made of fluorinated resin material or silicone resin material.

The belt 603 of this embodiment has dimensions of 30 mm in the outer diameter, 330 mm in the length (the dimension measured in the front-rear direction in FIG. 2), and 30 μm in the thickness, and the material of the base material 603*a* is nickel. The silicone rubber elastic layer 603*b* having a thickness of 400 μm is formed on the base material 603*a*, and a fluorine resin tube (parting layer 603*c*) having a thickness of 20 μm coats the elastic layer 603*b*.

The belt contacting surface of the substrate 610 may be provided with a polyimide layer having a thickness of 10 μm as a sliding layer 603*d*. When the polyimide layer is provided, the rubbing resistance between the fixing belt 603 and the heater 600 is low, and therefore, the wearing of the inner surface of the belt 603 can be suppressed. In order to further enhance the slidability, a lubricant such as grease may be applied to the inner surface of the belt.

The heater holder 601 (holder 601) functions to hold the heater 600 in the state of urging the heater 600 toward the inner surface of the belt 603. The holder 601 has a semi-arcuate cross-section (the surface of FIG. 2) and functions to regulate the rotation orbit of the belt 603. The holder 601 may be made of heat resistive resin material or the like. In this embodiment, it is Zenite 7755 (tradename) available from Dupont.

The support stay 602 supports the heater 600 by way of the holder 601. The support stay 602 is preferably made of a material that is not easily deformed even when a high pressure is applied thereto, and in this embodiment, it is made of SUS304 (stainless steel).

As shown in FIG. 3, the support stay 602 is supported by left and right flanges 411*a* and 411*b* at the opposite end portions with respect to the longitudinal direction. The flanges 411*a* and 411*b* may be simply called the flange 411. The flange 411 regulates the movement of the belt 603 in the longitudinal direction and the circumferential direction configuration of the belt 603. The flange 411 is made of heat resistive resin material or the like. In this embodiment, it is PPS (polyphenylenesulfide resin material).

Between the flange 411*a* and a pressing arm 414*a*, an urging spring 415*a* is compressed. Also, between a flange 411*b* and a pressing arm 414*b*, an urging spring 415*b* is compressed. The urging springs 415*a* and 415*b* may be simply called the urging spring 415. With such a structure, an elastic force of the urging spring 415 is applied to the heater 600 through the flange 411 and the support stay 602. The belt 603 is pressed against the upper surface of the roller 70 at a predetermined urging force to form the nip N having a predetermined nip width. In this embodiment, the pressure is 156.8 N (16 kgf) at one end portion side and 313.6 N (32 kgf) in total.

As shown in FIG. 3, connectors 700*a*, 700*b* are provided as an electric energy supply member electrically connected with the heater 600 to supply the electric power to the heater 600. The connectors 700*a* and 700*b* are collectively called the connector 700. The connector 700*a* is detachably provided at one longitudinal end portion of the heater 600. The connector 700*b* is detachably provided at the other longitudinal end portion of the heater 600. The connector 700 is easily detachably mounted to the heater 600, and therefore, assembling of the fixing device 40 and the exchange of the heater 600 or belt 603 upon damage of the heater 600 is easy, thus providing a good maintenance property. Details of the connector 700 will be described hereinafter.

As shown in FIG. 2, the roller 70 is a nip forming member which contacts an outer surface of the belt 603 to cooperate with the belt 603 to form the nip N. The roller 70 has a multi-layer structure on a metal core 71 composed of metal material, the multi-layer structure including an elastic layer 72 on the metal core 71 and a parting layer 73 on the elastic layer 72. Examples of the materials of the metal core 71 include SUS (stainless steel), SUM (sulfur and sulfur-containing free-machining steel), Al (aluminum) or the like. Examples of the materials of the elastic layer 72 include an elastic solid rubber layer, an elastic foam rubber layer, an elastic porous rubber layer or the like. Examples of the materials of the parting layer 73 include fluorinated resin material.

The roller 70 of this embodiment includes a metal core 71 of steel, an elastic layer 72 of silicone rubber foam on the metal core 71, and a parting layer 73 of fluorine resin tube on the elastic layer 72. Dimensions of the portion of the roller 70 having the elastic layer 72 and the parting layer 73 are 25 mm in outer diameter, and 330 mm in length.

A thermistor 630 is a temperature sensor is provided on a back side of the heater 600 (opposite side from the sliding surface side. The thermistor 630 is bonded to the heater 600 in the state that it is insulated from the heat generating element 620. The thermistor 630 has a function of detecting the temperature of the heater 600. As shown in FIG. 5, the thermistor 630 is connected with a control circuit 100 through an A/D converter (unshown) and feeds an output corresponding to the detected temperature to the control circuit 100.

The control circuit 100 comprises a circuit including a CPU operating for various controls, a non-volatile medium such as a ROM storing various programs. The programs are stored in the ROM, and the CPU reads and execute them to effect the various controls. The control circuit 100 may be an integrated circuit, such as ASIC, if it is capable of performing the similar operation.

As shown in FIG. 5, the control circuit 100 is electrically connected with the voltage source 110 so as to control electric power supply from the voltage source 110. The control circuit 100 is electrically connected with the thermistor 630 to receive the output of the thermistor 630.

The control circuit 100 uses the temperature information acquired from the thermistor 630 for the electric power supply control for the voltage source 110. More particularly, the control circuit 100 controls the electric power to the heater 600 through the voltage source 110 on the basis of the output of the thermistor 630. In this embodiment, the control circuit 100 carries out a wave number control of the output of the voltage source 110 to adjust the amount of heat generation of the heater 600. By such a control, the heater 600 is maintained at a predetermined temperature (180 degree C., for example).

As shown in FIG. 3, the metal core 71 of the roller 70 is rotatably held by bearings 41*a* and 41*b* provided in a rear side and a front side of the side plate 41, respectively. One axial end of the metal core 71 is provided with a gear G to transmit the driving force from a motor M to the metal core 71 of the roller 70. As shown in FIG. 2, the roller 70 receiving the driving force from the motor M rotates in the direction indicated by the arrow (clockwise direction). In the nip N, the driving force is transmitted to the belt 603 by the way of the roller 70, so that the belt 603 is rotated in the direction indicated by the arrow (counterclockwise direction).

The motor M is a driving means for driving the roller 70 through the gear G. As shown in FIG. 5, the control circuit 100 is electrically connected with the motor M to control the electric power supply to the motor M. When the electric energy is supplied by the control of the control circuit 100, the motor M starts to rotate the gear G.

The control circuit 100 controls the rotation of the motor M. The control circuit 100 rotates the roller 70 and the belt 603 using the motor M at a predetermined speed. It controls the motor so that the speed of the sheet P nipped and fed by the nip N in the fixing process operation is the same as a predetermined process speed (200 [mm/sec], for example).

[Heater]

Figure 9:
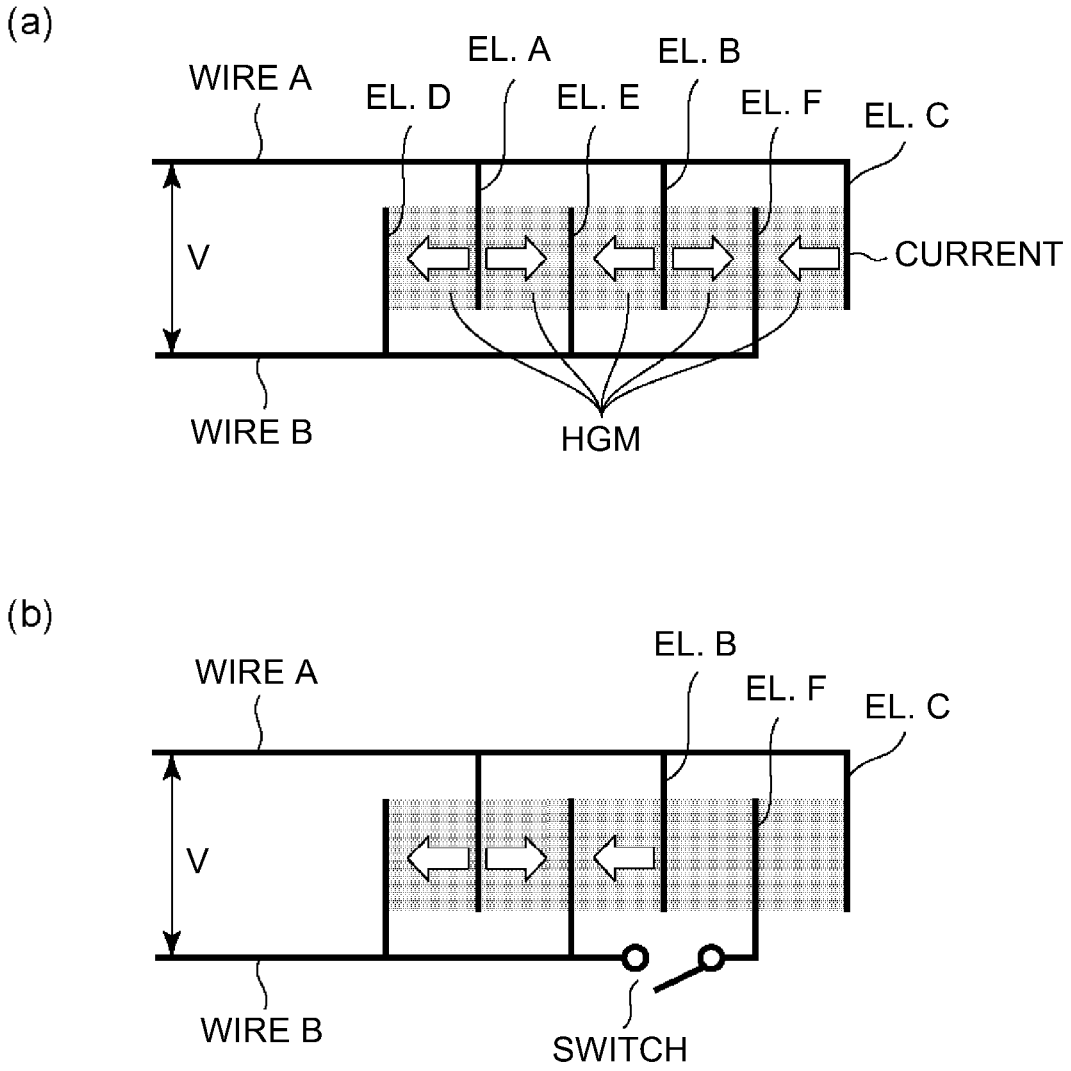
In FIG. 9, (*a*) illustrates a heat generating type for the heater, and (*b*) illustrates a switching system for a heat generating region of the heater.

The structure of the heater 600 used in the fixing device 40 will be described in detail. In FIG. 9,(*a*) illustrates a heat generating type used in the heater 600, and (*b*) illustrates a heat generating region switching type used with the heater 600.

The heater 600 of this embodiment is a heater using the heat generating type shown in (a) and (b) of FIG. 9. As shown in (a) of FIG. 9, electrodes A-C are electrically connected with an A-electroconductive-line ("WIRE A"), and electrodes D-F are electrically connected with a B-electroconductive-line ("WIRE B"). The electrodes connected with the A-electroconductive-lines and the electrodes connected with the B-electroconductive-lines are interlaced (alternately arranged) along the longitudinal direction (left-right direction in (a) of FIG. 9), and heat generating elements are electrically connected between the adjacent electrodes. The electrodes and the electroconductive lines are electroconductor patterns (lead wires) formed in a similar manner. In this embodiment, a lead wire portion extending in a widthwise direction of the substrate so as to be electrically connected with the heat generating element is referred to as the electrode, and a lead wire portion which extends in a longitudinal direction of the substrate and performs the function of connecting a portion, to which the voltage is applied, with the electrode is referred to as the electroconductive line (electric power supplying line). When a voltage V is applied between the A-electroconductive-line and the B-electroconductive-line, a potential difference is generated between the adjacent electrodes. As a result, electric currents flow through the heat generating elements, and the directions of the electric currents through the adjacent heat generating elements are opposite to each other. In this type of heater, the heat is generated in the above-described the manner. As shown in (b) of FIG. 9, between the B-electroconductive-line and the electrode F, a switch or the like is provided, and when the switch is opened, the electrode B and the electrode C are at the same potential, and therefore, no electric current flows through the heat generating element therebetween. In this system, the heat generating elements arranged in the longitudinal direction are independently energized so that only a part of the heat generating elements can be energized by switching a part off. In other words, in the system, the heat generating region can be changed by providing a switch or the like in the electroconductive line. In the heater 600, the heat generating region of the heat generating element 620 can be changed using the above-described system.

The heat generating element capable of generating Joule heat generates heat when energized, irrespective of the direction of the electric current, but it is preferable that the heat generating elements and the electrodes are arranged so that the currents flow along the longitudinal direction. Such an arrangement is advantageous over the arrangement in which the directions of the electric currents are in the widthwise direction perpendicular to the longitudinal direction (up-down direction in (a) of FIG. 9) in the following point. When joule heat generation is effected by the electric energization of the heat generating element, the heat generating element generates heat corresponding to the resistance thereof, and therefore, the dimensions and the material of the heat generating element are selected in accordance with the direction of the electric current so that the resistance is at a desired level. The dimension of the substrate on which the heat generating element is provided is very short in the widthwise direction as compared with that in the longitudinal direction. Therefore, if the electric current flows in the widthwise direction, it is difficult to provide the heat generating element with a desired resistance value, using a low resistance material. On the other hand, when the electric current flows in the longitudinal direction, it is relatively easy to provide the heat generating element with a desired resistance value, using the low resistance material. In addition, when a high resistance material is used for the heat generating element, a temperature non-uniformity may result from non-uniformity in the thickness of the heat generating element when it is energized.

For example, when the heat generating element material is applied on the substrate along the longitudinal direction by screen printing or like, a thickness non-uniformity of about 5% may result in the widthwise direction. This is because a heat generating element material painting non-uniformity occurs due to a small pressure difference in the widthwise direction by a painting blade. For this reason, it is preferable that the heat generating elements and the electrodes are arranged so that the electric currents flow in the longitudinal direction.

In the case that the electric power is supplied individually to the heat generating elements arranged in the longitudinal direction, it is preferable that the electrodes and the heat generating elements are disposed such that the directions of the electric current flow alternates between adjacent ones. As to the arrangements of the heat generating members and the electrodes, it would be considered to arrange the heat generating elements each connected with the electrodes at the opposite ends thereof, in the longitudinal direction, and the electric power is supplied in the longitudinal direction.

However, with such an arrangement, two electrodes are provided between adjacent heat generating elements, with the result of the likelihood of short circuit. In addition, the number of required electrodes is large with the result of large non- heat generating portion between the heat generating elements. Therefore, it is preferable to arrange the heat generating elements and the electrodes such that an electrode is made common between adjacent heat generating elements. With such an arrangement, the likelihood of a short circuit between the electrodes can be avoided, and the space between the electrodes can be eliminated.

In this embodiment, a common electroconductive line 640 shown in FIG. 4 corresponds to A-electroconductive-line of (a) of FIG. 9, and opposite electroconductive lines 650, 660*a*, 660*b* (FIG. 4) correspond to B-electroconductive-line ((a) of FIG. 9). In addition, common electrodes 642*a*-642*g* as a first electrode layer (FIG. 4) correspond to electrodes A-C ((a) of FIG. 9), and opposite electrodes 652*a*-652*d*, 662*a*, 662*b* as a second electrode layer (FIG. 4) correspond to electrodes D-F ((a) of FIG. 9). Heat generating elements 620*a*-620*l* (FIG. 4) correspond to the heat generating elements of (a) of FIG. 9. Hereinafter, the common electrodes 642*a*-642*g* are simply referred to as the electrode 642. The opposite electrodes 652*a*-652*d* are simply called the electrode 652. The opposite electrodes 662*a*, 662*b* are simply called the electrode 662. The electroconductive lines 660*a*, 660*b* are simply called the opposite electroconductive line 660. The heat generating elements 620*a*-620*l* are simply called the heat generating element 620. The structure of the heater 600 will be described in detail referring to the accompanying drawings.

Figure 6:
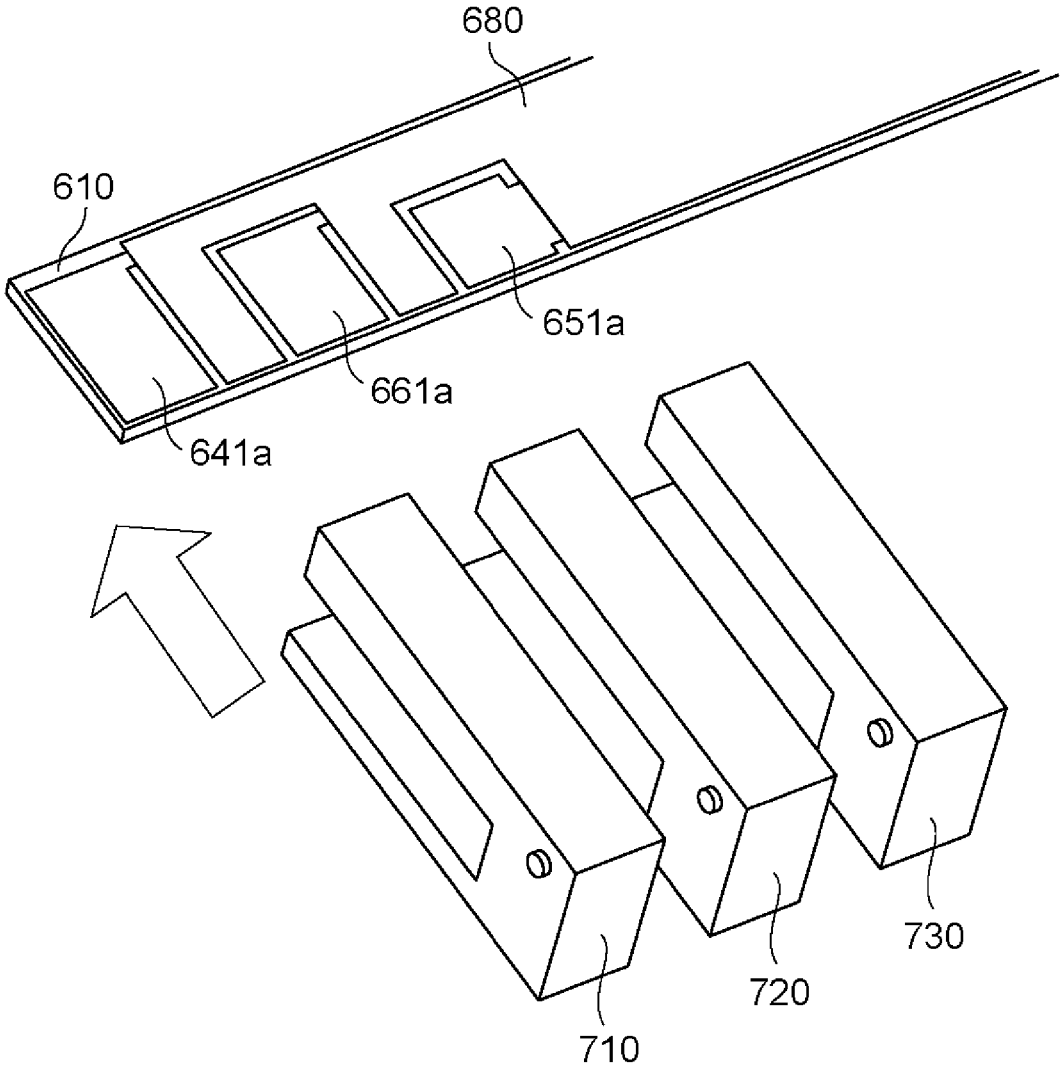
FIG. 6 illustrates a connector.

As shown in FIGS. 4 and 6, the heater 600 comprises the substrate 610, the heat generating element 620 on the substrate 610, an electroconductor pattern (electroconductive line), and an insulation coating layer 680 covering the heat generating element 620 and the electroconductor pattern.

The substrate 610 determines the dimensions and the configuration of the heater 600 and is contactable to the belt 603 along the longitudinal direction of the substrate 610. The material of the substrate 610 is a ceramic material such as alumina, aluminum nitride or the like, which has a high heat resistivity, thermo-conductivity, an electrical insulative property or the like. In this embodiment, the substrate is a plate member of alumina having a length (measured in the left-right direction in FIG. 4) of about 420 mm, a width (up-down direction in FIG. 4) of 10 mm and a thickness of 1 mm. The alumina plate member is 30 W/m·K in thermal conductivity.

On the back surface of the substrate 610, the heat generating element 620 and the electroconductor pattern (electroconductive line) are provided through a thick film printing method (screen printing method) using an electroconductive thick film paste. In this embodiment, a silver paste is used for the electroconductor pattern so that the resistivity is low, and a silver-palladium alloy paste is used for the heat generating element 620 so that the resistivity is high. As the paste for forming the heat generating element, a paste or the like of ruthenium oxide may also be used. As shown in FIG. 6, the heat generating element 620 and the electroconductor pattern are coated with the insulation coating layer 680 of heat resistive glass, so that they are electrically protected from leakage and a short circuit. For that reason, in this embodiment, a gap between adjacent electroconductive lines can be provided narrowly. However, the insulation coating layer 680 is not necessarily provided on the heater 600. For example, by providing the adjacent electroconductive lines with a large gap, it is possible to prevent a short circuit between the adjacent electroconductive lines. However, it is desirable that a constitution in which the insulation coating layer 680 is provided from the viewpoint that the heater 600 can be downsized.

As shown in FIG. 4, there are provided electrical contacts 641*a*, 651*a*, 661*a* as a part of the electroconductor pattern in one end portion side 610*a* of the substrate 610 with respect to the longitudinal direction. Further, there are provided electrical contacts 641*b*, 651*b*, 661*b* as a part of the electroconductor pattern in the other end portion side 610*b* of the substrate 610 with respect to the longitudinal direction. In addition, there are provided the heat generating element 620, common electrodes 642*a*-642*g* and opposite electrodes 652*a*-652*d*, 662*a*, 662*b* as a part of the electroconductor pattern in a central region 610*c* of the substrate 610 with respect to the longitudinal direction of the substrate 610. Between the one end portion side 610*a* of the substrate and the other end portion side 610*b*, there is the central region 610*c*. In one end portion side 610*d* of substrate 610 beyond the heat generating element 620 with respect to the widthwise direction, the electroconductive line 640 as a part of the electroconductor pattern is provided. In the other end portion side 610*e* of the substrate 610 beyond the heat generating element 620 with respect to the widthwise direction, the electroconductive lines 650 and 660 are provided as a part of the electroconductor pattern.

The heat generating element 620 (620*a*-620*l*) is a resistor capable of generating joule heat by electric power supply (energization). The heat generating element 620 is one heat generating element member extending in the longitudinal direction on the substrate 610, and is disposed in a region 610*c* (FIG. 4) in the neighborhood of a substantially central portion of the substrate 610. The dimension of the heat generating element 620 are adjusted in a range of a width (measured in the widthwise direction of the substrate 610) of 1-4 mm and a thickness of 5-20 μm so as to provide a desired resistance value. The heat generating element 620 in this embodiment has the width of 2 mm and the thickness of 10 μm. The total length of the heat generating element 620 in the longitudinal direction is 320 mm, which is enough to cover a width of the A4 size sheet P (297 mm in width).

The heat generating element 620 is laminated on seven common electrodes 642*a*-642*g*, described above, arranged with gaps in the longitudinal direction of the substrate 610. In other words, the heat generating element 620 is isolated into six sections by electrodes 642*a*-642 *g* along the longitudinal direction. The lengths measured in the longitudinal direction of the substrate 610 of each section are 53.3 mm. On central portions of the respective sections of the heat generating element 620, one of the six electrodes 652, 662 (652*a*-652*d*, 662*a*, 662*b*) are laminated. In this manner, the heat generating element 620 is divided into 12 sub-sections. The heat generating element 620 divided into 12 sub-sections can be deemed as a plurality of heat generating elements (resistance elements) 620*a*-620*l*. In other words, the heat generating elements 620*a*-620*l* electrically connect adjacent electrodes with each other. The lengths of the sub-section measured in the longitudinal direction of the substrate 610 are 26.7 mm. The resistance values of the sub-section of the heat generating element 620 with respect to the longitudinal direction are 120Ω. With such a structure, the heat generating element 620 is capable of generating heat in a partial area or areas with respect to the longitudinal direction.

The resistances of the heat generating elements 620 with respect to the longitudinal direction are uniform, and the heat generating elements 620*a*-620*l* have substantially the same dimensions. Therefore, the resistance values of the heat generating elements 620*a*-620*l* are substantially equal. When they are supplied with electric power in parallel, the heat generation distribution of the heat generating element 620 is uniform. However, it is not inevitable that the heat generating elements 620*a*-620*l* have substantially the same dimensions and/or substantially the same resistivities. For example, the resistance values of the heat generating elements 620*a* and 620*l* may be adjusted so as to prevent local temperature lowering at the longitudinal end portions of the heat generating element 620. At the positions of the heat generating element 620 where the common electrode 642 and the opposite electrode 652, 662 are provided, the heat generation of the heat generating element 620 is substantially zero. However, there is a heat-uniformizing action of the substrate 610, and therefore by suppressing the thickness of the electrode to less than 1 mm, the influence on the fixing process is a negligible degree. In this embodiment, the thickness of each of the electrodes is less than 1 mm.

The common electrodes 642 (642*a*-642*g*) are a part of the above-described electroconductor pattern. The electrode 642 extends in the widthwise direction of the substrate 610 perpendicular to the longitudinal direction of the heat generating element 620. In this embodiment, of the electroconductor pattern formed on the heater 600, a region extending in the widthwise direction of the substrate so as to contact the heat generating element is referred to as the electrode. In this embodiment, a plurality of electrodes 642 are provided so as to be laminated on the heat generating element 620. The electrodes 642 are odd-numbered electrodes of the electrodes connected to the heat generating element 620, as counted from a one longitudinal end of the heat generating element 620. The electrode 642 is connected to one contact 110*a* of the voltage source 110 through the common electroconductive line 640, which will be described hereinafter. In this embodiment, the common electrode 642 is 0.1 mm in width and 10 μm in layer thickness.

The opposite electrodes 652, 662 are a part of the above-described electroconductor pattern. The opposite electrodes 652, 662 extend in the widthwise direction of the substrate 610 perpendicular to the longitudinal direction of the heat generating element 620. Each of the opposite electrodes 652, 662 includes a plurality of electrodes so as to be laminated on the heat generating element 620. The opposite electrodes 652, 662 are the other electrodes of the electrodes connected with the heat generating element 620 other than the above-described common electrode 642. That is, in this embodiment, they are even-numbered electrodes as counted from the one longitudinal end of the heat generating element 620. Each of the opposite electrodes 652, 662 is 0.1 mm in width and 10 μm in layer thickness.

That is, the common electrode 642 and the opposite electrodes 662, 652 are alternately arranged along the longitudinal direction of the heat generating element. The opposite electrodes 652, 662 are connected to the other contact 110*b* of the voltage source 110 through the opposite electroconductive lines 650, 660, which will be described hereinafter.

The electrode 642 and the opposite electrode 652, 662 function as electrode portions for supplying the electric power to the heat generating element 620. In this embodiment, the odd-numbered electrodes are common electrodes 642, and the even-numbered electrodes are opposite electrodes 652, 662, but the structure of the heater 600 is not limited to this example. For example, the even-numbered electrodes may be the common electrodes 642, and the odd-numbered electrodes may be the opposite electrodes 652, 662.

In addition, in this embodiment, four of the all opposite electrodes connected with the heat generating element 620 are the opposite electrode 652. In this embodiment, two of the all opposite electrodes connected with the heat generating element 620 are the opposite electrode 662. However, the allotment of the opposite electrodes is not limited to this example, but may be changed depending on the heat generation widths of the heater 600. For example, two may be the opposite electrode 652, and four may be the opposite electrode 662.

The electroconductive line 640 as a first electroconductive line is a part of the above-described electroconductor pattern. The common electroconductive line 640 extends along the longitudinal direction of the substrate 610 toward both end sides (one end portion side 610*a* and the other end portion side 610*b*) of the substrate in the one end portion side 610*d* of the substrate. The electroconductive line 640 is connected with the electrodes 642 (642*a*-642*g*) which is in turn connected with the heat generating element 620 (620*a*-620*l*). In this embodiment, the electroconductor patterns connecting the electrodes with the electrical contacts are called the electroconductive lines. The electroconductive line 640 is connected to the electrical contacts 641 (641*a*, 641*b*) which will be described hereinafter.

The opposite electroconductive line 650 as a second electroconductive line is a part of the above-described electroconductor pattern. The opposite electroconductive line 650 extends along the longitudinal direction of the substrate 610 toward both end sides (one end portion side 610*a* and the other end portion side 610*b*) of the substrate in the other end portion side 610*e* of the substrate. The electroconductive line 650 is connected with the electrodes 652 (652*a*-652*d*), which is, in turn, connected with the heat generating element 620 (620*c*-620*j*). Ends of the electroconductive line 650 are connected to the electrical contacts 651 (651*a*, 651*b*) which will be described hereinafter.

The opposite electroconductive line 660 (660*a*, 660*b*) as a third electroconductive line is a part of the above-described electroconductor pattern. The electroconductive line 650*a* extends along the longitudinal direction of substrate 610 toward the one end portion side 610*a* of the substrate 610 in the other end portion side 610*e* of the substrate. The electroconductive line 660*a* is connected with the electrode 662*a*, which is, in turn, connected with the heat generating element 620 (620*a*, 620*b*). The electroconductive line 660*a* is connected to the electrical contact 661*a* which will be described hereinafter. The electroconductive line 660*b* extends along the longitudinal direction of substrate 610 toward the other end portion side 610*b* of the substrate 610 in the other end portion side 610*e* of the substrate 610. The electroconductive line 660*b* is connected with the opposite electrode 662*b*, which is, in turn, connected with the heat generating element 620 (620*k*, 620*l*). The electroconductive line 660*b* is connected to the electrical contact 661*b* which will be described hereinafter.

The electrical contacts 641 (641*a*, 641*b*), 651 (651*a*, 651*b*), 661 (661*a*, 661*b*) are a part of the above-described electroconductor pattern. The electrical contacts 641*a*, 651*a*, 661*a* are provided and arranged in the one end portion side 610*a* of the substrate 610 relative to the heat generating element 620 with gaps of about 4 mm in the longitudinal direction of the substrate 610. The electrical contacts 641*b*, 651*b*, 661*b* are provided and arranged in the other end portion side 610*b* of the substrate 610 relative to the heat generating element 620 with gaps of about 4 mm in the longitudinal direction of the substrate 610. Each of the electrical contacts 641, 651, 661 preferably has an area of not less than 2.5 mm×2.5 mm in order to assure the reception of the electric power supply from the connector 700 as an energizing portion which will be described hereinafter. In this embodiment, each of the electrical contacts 641, 651, 661 has a length of about 3 mm measured in the longitudinal direction of the substrate 610 and a width of not less than 2.5 mm measured in the widthwise direction of the substrate 610. As shown in FIG. 6, no insulating coat layer 680 is provided at the positions of the electrical contacts 641, 651, 661, so that the electrical contacts are exposed. Therefore, the electrical contacts 641, 651, 661 are contactable to the connector 700 to establish an electrical connection therewith.

When voltage is applied between the electrical contact 641 and the electrical contact 651 through the connection between the heater 600 and the connector 700, a potential difference is produced between the electrode 642 (642*b*-642*f*) and the electrode 652 (652*a*-652*d*). Therefore, through the heat generating elements 620*c*, 620*d*, 620*e*, 620*f*, 620*g*, 620*h*, 620*i*, 620*j*, the currents flow along the longitudinal direction of the substrate 610, the directions of the currents through the adjacent heat generating elements being substantially opposite to each other. The heat generating elements 620*c*, 620*d*, 620*e*, 620*f*, 620*g*, 620*h*, 620*i* as a first heat generating region generate heat, respectively.

When voltage is applied between the electrical contact 641 and the electrical contact 661*a* through the connection between the heater 600 and the connector 700, a potential difference is produced between the electrodes 642*a*, 642*b* and the opposite electrode 662*a*. Therefore, through the heat generating elements 620*a*, 620*b*, the currents flow along the longitudinal direction of the substrate 610, the directions of the currents through the adjacent heat generating elements being opposite to each other. The heat generating elements 620*a*, 620*b* as a second heat generating region adjacent the first heat generating region generate heat.

When voltage is applied between the electrical contact 641 and the electrical contact 661*b* through the connection between the heater 600 and the connector 700, a potential difference is produced between the common electrodes 642*f*, 642*g* and the electrode 662*b*. Therefore, through the heat generating elements 620*k*, 620*l*, the currents flow along the longitudinal direction of the substrate 610, the directions of the currents through the adjacent heat generating elements being opposite to each other. By this, the heat generating elements 620*k*, 620*l* as a third heat generating region adjacent to the first heat generating region generate heat.

In this manner, on the heater 600, a part of the heat generating elements 620 can be selectively energized.

[Connector]

Figure 7:
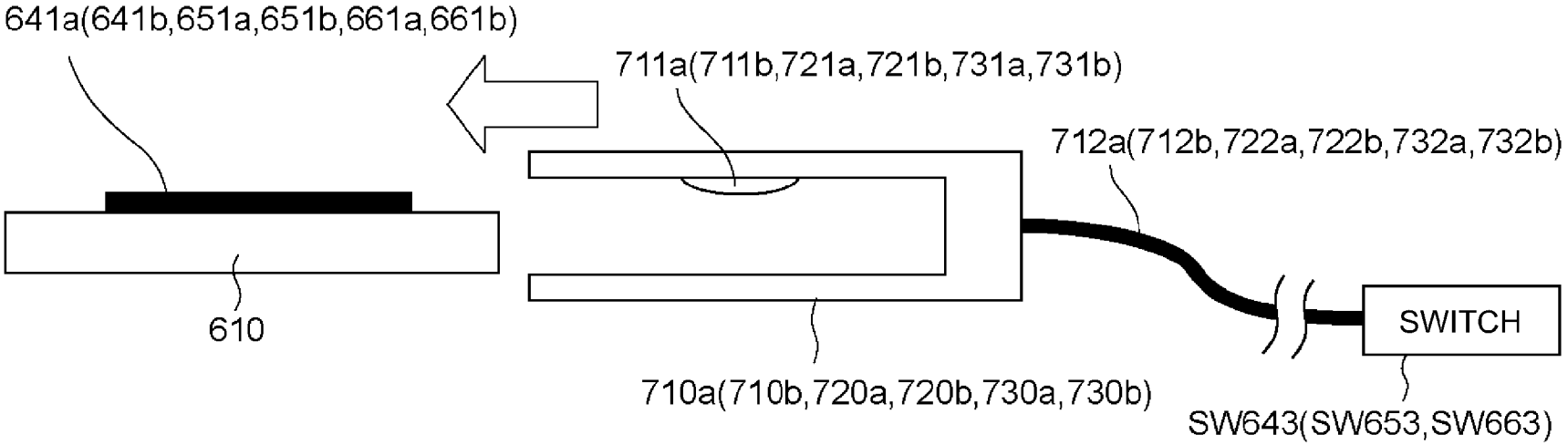
FIG. 7 illustrates a contact terminal.
Figure 8:
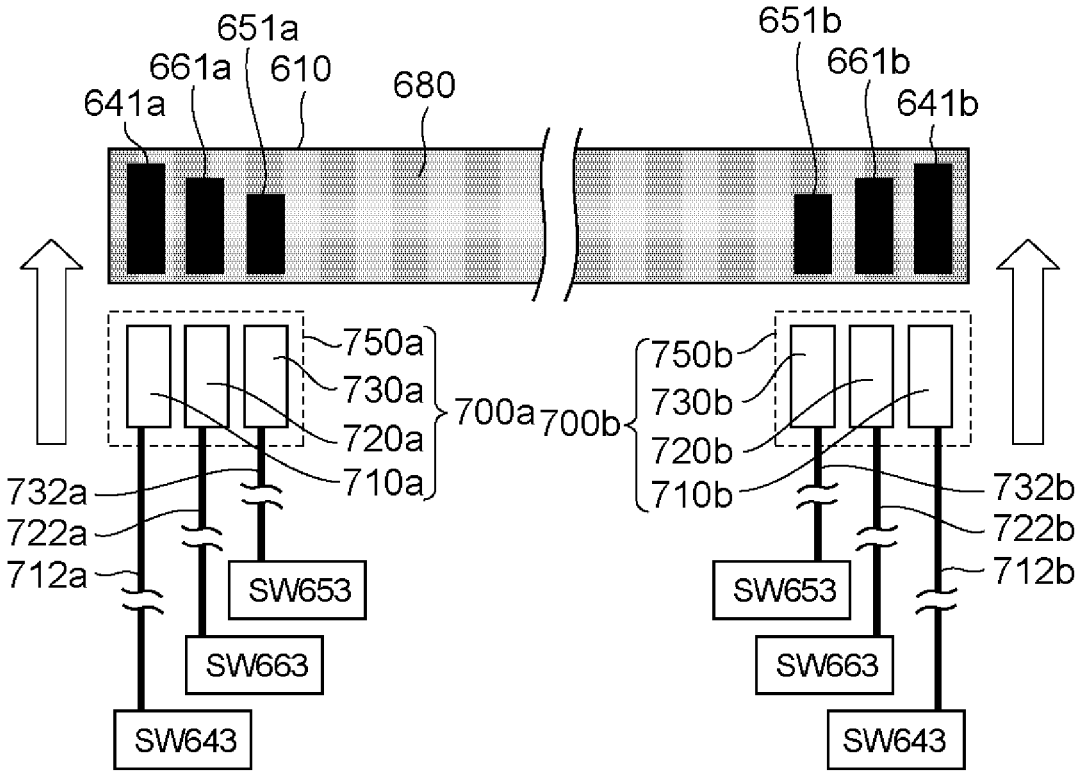
FIG. 8 illustrates mounting of the connector.

The connector 700 used with the fixing device 40 will be described in detail. FIG. 7 is an illustration of a contact terminal 710. FIG. 8 is a schematic view for illustrating a manner of mounting the connector 700 to the heater 600. The connectors 700*a* and 700*b* in this embodiment includes contact terminals 710*a*, 710*b*, 720*a*, 720*b*, 730*a* and 730*b*. The connector 700 is electrically connected with the heater 600 by mounting to the heater 600. The connector 700*a* comprises a contact terminal 710*a* electrically connectable with the electrical contact 641*a*, a contact terminal 720*a* electrically connectable with the electrical contact 661*a*, and a contact terminal 730*a* electrically connectable with the electrical contact 651*a*. The connector 700*b* comprises a contact terminal 710*b* electrically connectable with the electrical contact 641*b*, a contact terminal 720*b* electrically connectable with the electrical contact 661*b*, and a contact terminal 730*b* electrically connectable with the electrical contact 651*b*. Each of the connectors 700*a* and 700*b* sandwiches the front and back substrates of the heater 600 so as to be mounted the heater 600, by which the contact terminals are electrically connected with the electrical contacts, respectively. In the fixing device 40 of this embodiment having the above-described structures, no soldering or the like is used for the electrical connection between the connectors and the electrical contacts. Therefore, the electrical connection between the heater 600 and the connector 700, which rise in temperature during the fixing process operation, can be accomplished and maintained with high reliability. In the fixing device 40 of this embodiment, the connector 700 is detachably mountable relative to the heater 600, and therefore, the belt 603 and/or the heater 600 can be replaced without difficulty. The structure of the connector 700 will be described in detail.

As shown in FIG. 8, the connector 700*a* provided with the metal contact terminals 710*a*, 720*a*, 730*a* is mounted to the heater 600 from a widthwise end Portion in one end portion side 610*a* of the substrate 610. The connector 700*b* provided with the metal contact terminals 710*b*, 720*b*, 730*b* is mounted to the heater 600 from a widthwise end portion in the other end portion side 610*b* of the substrate 610.

The terminals 710, 720, 730 will be described, taking the terminal 710*a* for instance. As shown in FIG. 7, the terminal 710*a* functions to electrically connect the electrical contact 641*a* to a switch SW643 which will be described hereinafter. The terminal 710*a* is provided with a cable 712*a* for the electrical connection between the switch SW643 and the electrical contact 711*a* for contacting to the electrical contact 641. The connector 700*a* includes a housing 750*a* for integrally holding the contact terminals 710*a*, 720*a*, 730*a*. The connector 700*b* includes a housing 750*b* for integrally holding the contact terminals 710*b*, 720*b*, 730*b*. The terminal 710*a* has a channel-like configuration, and by moving in the direction indicated by an arrow in FIG. 7, it can receive the heater 600. The portion of the connector 700*a* that contacts the electrical contact 641*a* is provided with the electrical contact 711*a* which contacts the electrical contact 641*a*, by which the electrical connection is established between the electrical contact 641*a* and the contact terminal 710*a*. The electrical contact 711*a* has a leaf spring property, and therefore, contacts the electrical contact 641*a* while pressing against it. Therefore, the contact 710 sandwiches the heater 600 between the front and back sides to fix the position of the heater 600.

Similarly, the terminal 710*b* functions to contact the electrical contact 641*b* with the switch SW643 which will be described hereinafter. The terminal 710*b* is provided with the electrical contact 711*b* for connection to the electrical contact 641*b* and a cable 712*b* for connection to the switch SW643.

Similarly, the terminals 720 (720*a*, 720*b*) function to contact the electrical contacts 661 (661*a*, 661*b*) with the switch SW663 which will be described hereinafter. The terminals 720 (720*a*, 720*b*) are provided with the electrical contacts 721*a*, 721*b* for connection to the electrical contacts 661*a*, 661*b* and cables 722*a*, 722*b* for connection to the switch SW663.

Similarly, the terminals 730 (730*a*, 730*b*) function to contact the electrical contacts 651 (651*a*, 651*b*) with the switch SW653 which will be described hereinafter. The terminals 730 (730*a*, 730*b*) are provided with the electrical contacts 731*a*, 731*b* for connection to the electrical contacts 651*a*, 651*b* and cables 732*a*, 732*b* for connection to the switch SW653.

As shown in FIG. 8, the metal contact terminals 710*a*, 720*a*, 730*a* of metal are integrally supported on the housing 750*a* of resin material. The terminals 710*a*, 720*a*, 730*a* are provided in the housing 750*a* with spaces between adjacent ones so as to be connected with the electrical contacts 641*a*, 661*a*, 651*a*, respectively when the connector 700*a* is mounted to the heater 600. Between adjacent contact terminals, partitions are provided to electrically insulate between the adjacent contact terminals.

Further, the metal contact terminals 710*b*, 720*b*, 730*b* of metal are integrally supported on the housing 750*b* of resin material. The terminals 710*b*, 720*b*, 730*b* are provided in the housing 750*b* with spaces between adjacent ones so as to be connected with the electrical contacts 641*b*, 661*b*, 651*b*, respectively when the connector 700*b* is mounted to the heater 600. Between adjacent contact terminals, partitions are provided to electrically insulate between the adjacent contact terminals.

In this embodiment, the connector 700 is mounted in the widthwise direction of the substrate 610, but this mounting method is not limiting to the present invention. For example, the structure may be such that the connector 700 is mounted in the longitudinal direction of the substrate.

[Electric Energy Supply to Heater]

An electric energy supply method to the heater 600 will be described. The fixing device 40 of this embodiment is capable of changing the width of the heat generating region of the heater 600 by controlling the electric energy supply to the heater 600 in accordance with the width size of the sheet P. With such a structure, the heat can be efficiently supplied to the sheet P. In the fixing device 40 of this embodiment, the sheet P is fed with the center of the sheet P aligned with the center of the fixing device 40, and therefore, the heat generating region extend from the center portion. The electric energy supply to the heater 600 will be described in conjunction with the accompanying drawings.

The voltage source 110 is a circuit for supplying the electric power to the heater 600. The voltage source 110 in this embodiment is an AC circuit used in connection with the commercial voltage source (AC voltage source) of 100V in effective value (single phase AC). The voltage source 110 of this embodiment is provided with a voltage source contact 110*a* and a voltage source contact 110*b* having different electric potential. The voltage source 110 may be DC voltage source if it has a function of supplying the electric power to the heater 600.

As shown in FIG. 5, the control circuit 100 is electrically connected with switch SW643, switch SW653, and switch SW663, respectively to control the switch SW643, switch SW653, and switch SW663, respectively.

Switch SW643 is a switch (relay) provided between the voltage source contact 110*a* and the electrical contact 641. The switch SW643 connects or disconnects between the voltage source contact 110*a* and the electrical contact 641 in accordance with the instructions from the control circuit 100. The switch SW653 is a switch provided between the voltage source contact 110*b* and the electrical contact 651. The switch SW653 connects or disconnects between the voltage source contact 110*b* and the electrical contact 651 in accordance with the instructions from the control circuit 100. The switch SW663 is a switch provided between the voltage source contact 110*b* and the electrical contact 661 (661*a*, 661*b*). The switch SW663 connects or disconnects between the voltage source contact 110*b* and the electrical contact 661 (661*a*, 661*b*) in accordance with the instructions from the control circuit 100.

When the control circuit 100 receives the execution instructions of a job, the control circuit 100 acquires the width size information of the sheet P to be subjected to the fixing process. In accordance with the width size information of the sheet P, a combination of ON/OFF of the switch SW643, switch SW653, switch SW663 is controlled so that the heat generation width of the heat generating element 620 fits the sheet P. At this time, the control circuit 100, the voltage source 110, switch SW643, switch SW653, switch SW663 and the connector 700 functions as an electric energy supplying means (energizing portion) for supplying the electric power to the heater 600.

When the sheet P is a large size sheet (an introducible maximum width size), that is, when A3 size sheet is fed in the longitudinal direction or when the A4 size is fed in the landscape fashion, the width of the sheet P is 297 mm. Therefore, the control circuit 100 controls the electric power supply to provide the heat generation width B (FIG. 5) of the heat generating element 620. To effect this, the control circuit 100 renders ON all of the switch SW643, switch SW653, switch SW663. As a result, the heater 600 is supplied with the electric power through the electrical contacts 641, 661*a*, 661*b*, 651, so that all of the 12 sub-sections of the heat generating element 620 generate heat. At this time, the heater 600 generates the heat uniformly over the 320 mm region to meet the 297 mm sheet P.

When the size of the sheet P is a small size (a width size narrower than the maximum width size by a predetermined width), that is, when an A4 size sheet is fed longitudinally, or when an A5 size sheet is fed in the landscape fashion, the width of the sheet P is 210 mm. Therefore, the control circuit 100 provides a heat generation width A (FIG. 5) of the heat generating element 620. Therefore, the control circuit 100 renders ON the switch SW643, switch SW653 and renders OFF the switch SW663. As a result, the heater 600 is supplied with the electric power through the electrical contacts 641, 651, only 8 sub-sections of the 12 heat generating element 620 generate heat. At this time, the heater 600 generates the heat uniformly over the 213 mm region to meet the 210 mm sheet P.

[Arrangement of Heat Generating Element and Electrode]

Figure 10:
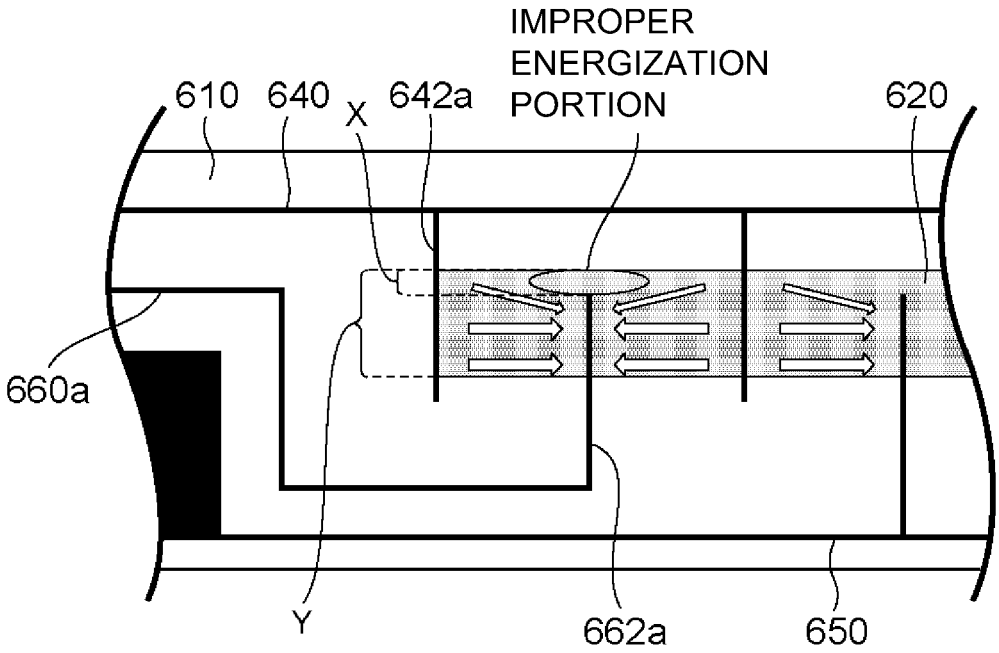
FIG. 10 is a schematic view partly showing a state on a substrate of a heater in a comparison example in which a deviation in printing generated between a heat generating element and an electroconductor pattern.
Figure 11:
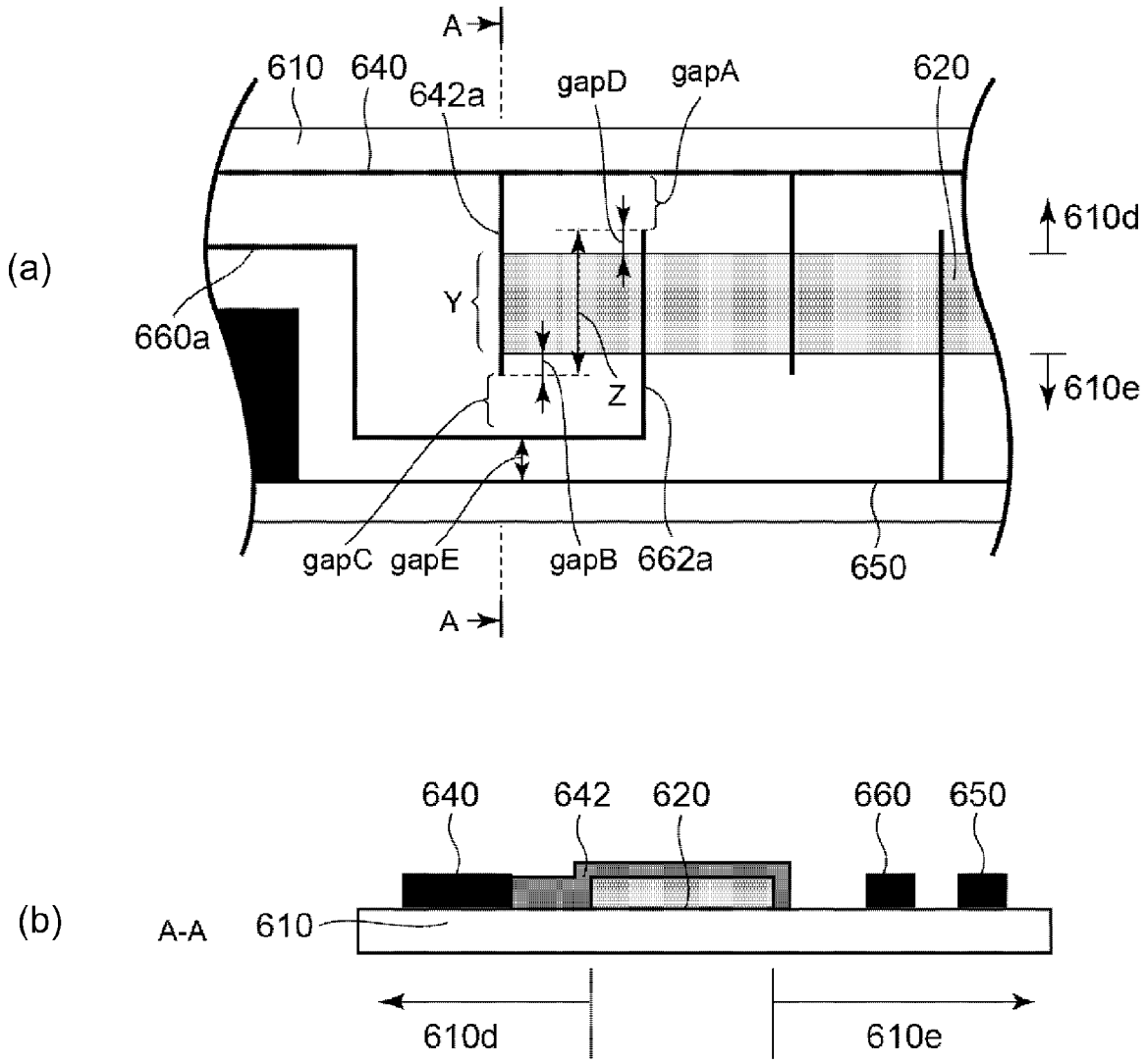
In FIG. 11, (*a*) and (*b*) are schematic views partly showing a state on a substrate of the heater in the embodiment.
Figure 12:
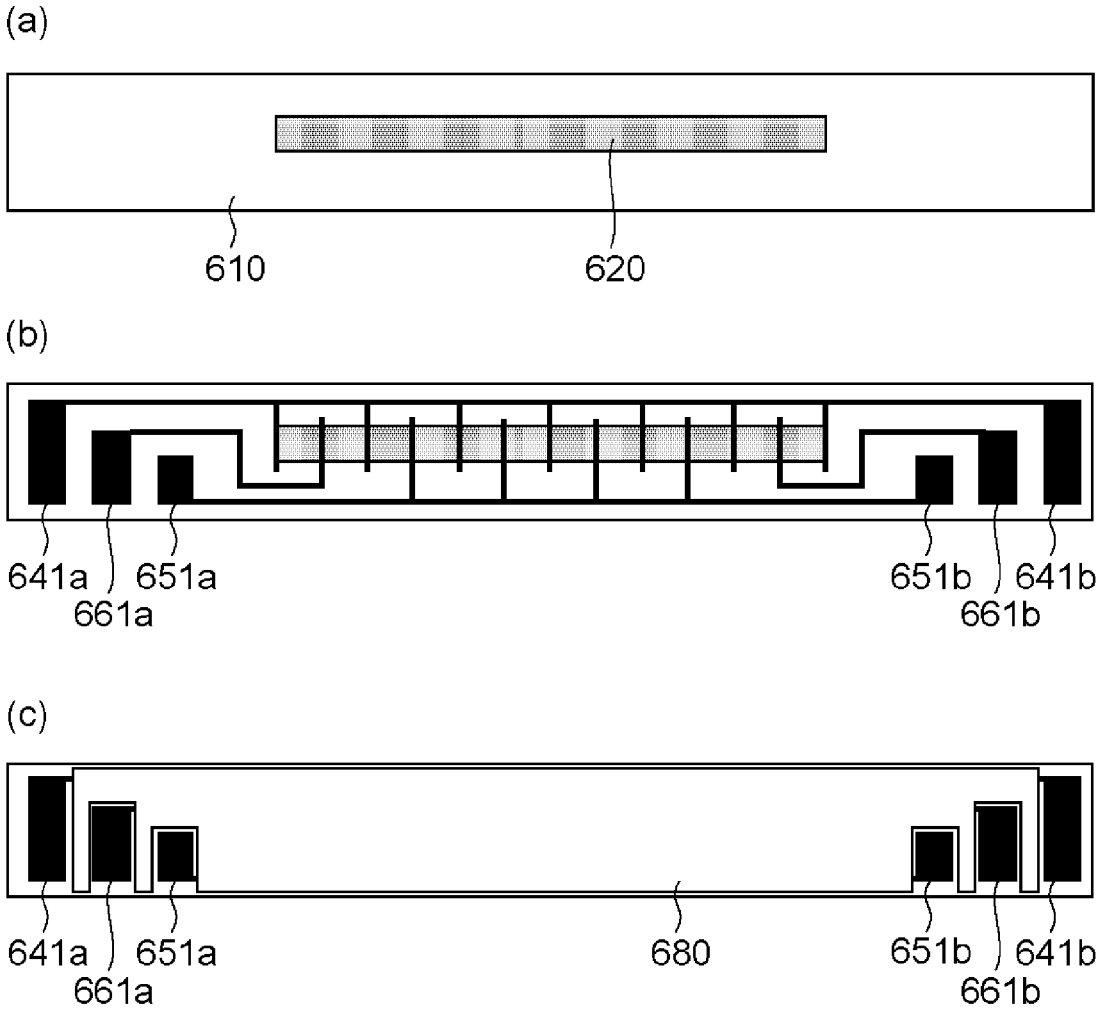
In FIG. 12, (*a*) to (*c*) are schematic views each for illustrating a printing step, in which (*a*) shows the printing step of the heat generating element, (*b*) shows the printing step of the electroconductor pattern, and (*c*) shows the printing step of a coat layer.
Figure 13:
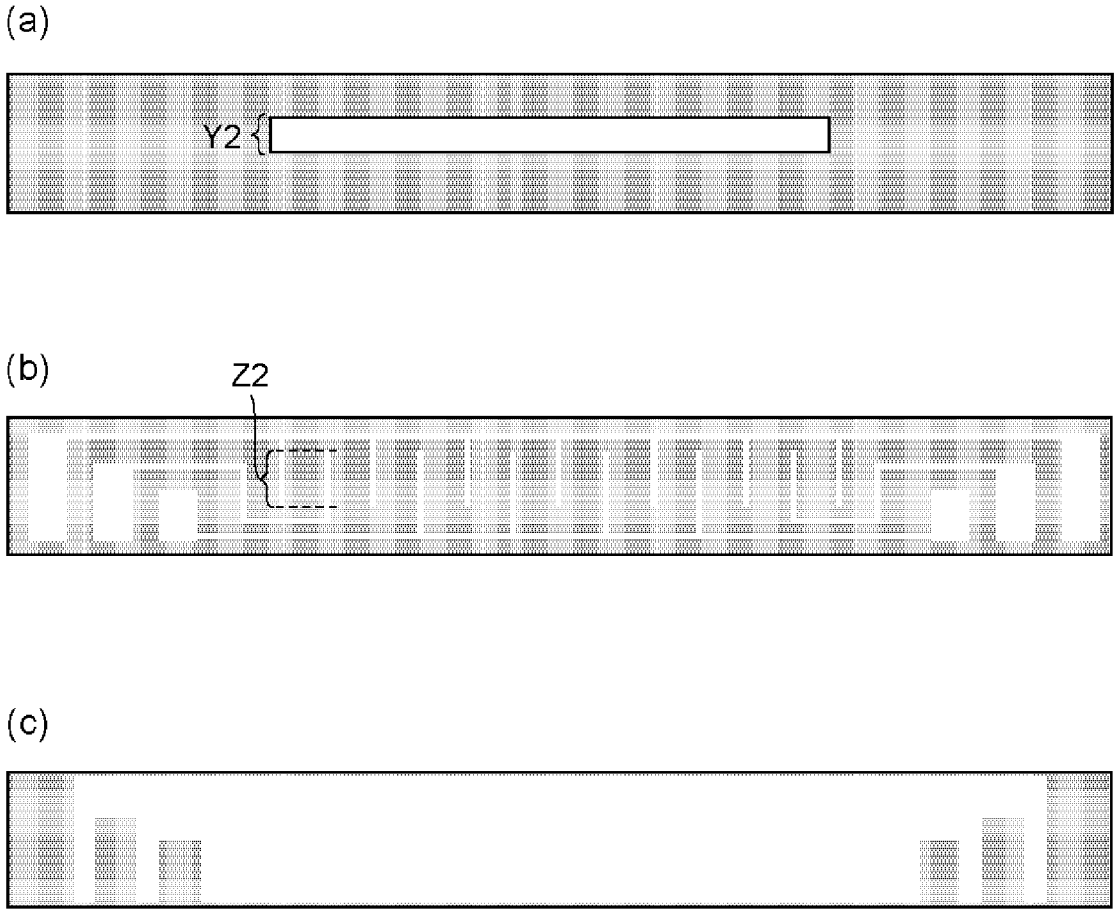
In FIG. 13, (*a*) to (*c*) are schematic views each showing a structure of a plate used for printing, in which (*a*) shows the structure of the plate used for printing of the heat generating element, (*b*) shows the structure of the plate used for printing of the electroconductor pattern, and (*c*) shows the structure of the plate used for printing of the coat layer.

A positional relation between the heat generating element 620 and the electrodes 642, 652, 662 will be described. FIG. 10 is a schematic view partly showing a state on the substrate of the heater in a comparison example in which a deviation in printing generated between a heat generating element and an electroconductor pattern. In FIG. 11,(*a*) and (*b*) are schematic views partly showing a state on the substrate of the heater in this embodiment. In FIG. 12,(*a*) to (*c*) are schematic views each for illustrating a printing step, in which (*a*) shows the printing step of the heat generating element, (*b*) shows the printing step of the electroconductor pattern, and (*c*) shows the printing step of a coat layer. In FIG. 13,(*a*) to (*c*) are schematic views each showing a structure of a plate used for printing, in which (*a*) shows the structure of the plate used for printing of the heat generating element, (*b*) shows the structure of the plate used for printing of the electroconductor pattern, and (*c*) shows the structure of the plate used for printing of the coat layer.

In the heater 600 in this embodiment, as described above using FIG. 9, to the heat generating element extending in the longitudinal direction of the substrate, the electric power (energy) is supplied from the electrodes each provided so as to cross the widthwise direction of the substrate. Here, the resistivity of the electrode is sufficiently lower than the resistivity of the heat generating element, and therefore the current first flows through the electrodes extending along the widthwise direction of the substrate and then flows through the heat generating element so as to cross the heat generating element positioned between adjacent electrodes. By such a constitution, the heater 600 can uniformly supply the electric power over an entire region with respect to the widthwise direction of the heat generating element. However, in the case where the electrodes extending along the widthwise direction of the substrate do not cross the heat generating element with reliability, there is a liability that the heat generating element causes improper heat generation. FIG. 10 shows a state of the heater in the comparison example in which printing positions of the heat generating element and the electrodes deviate from their normal positions. In the comparison example, the printing position of the heat generating element deviates from the normal position toward one end portion side (upward direction in FIG. 10) with respect to the widthwise direction of the substrate. Further, the printing positions of the electrodes and the electroconductive lines deviate from their normal positions toward the other end portion side (downward direction in FIG. 10) with respect to the widthwise direction of the substrate. For that reason, the electrodes 662*a*, 652*a* only reach a halfway position of the heat generating element with respect to the widthwise direction of the heat generating element. That is, in this state, a length X of the electrode 662*a* is shorter than a width Y of the heat generating element with respect to the widthwise direction. In this case, the current flows through the heat generating element as indicated by arrows in FIG. 10, so that an improper energization portion where the current is partly less liable to flow through the heat generating element is generated in the heat generating element. Then, this improper energization portion causes a partial temperature lowering of the heat generating element to result in temperature non-uniformity.

In the comparison example, of the width Y of the heat generating element, only a portion corresponding to a width (Y-X) normally functions as the heat generating element. That is, with respect to this heat generating element, a normally functioning width is smaller than a normal width.

Here, a resistance value of the heat generating element is calculated by: (resistance value)=(volume resistivity)×(length)/(width). For that reason, as in the comparison example, the heat generating element described in normally functioning width increases in the resistance thereof. That is, the heat generating element increases in resistance value with respect to the electric power supplied, and therefore, a heat generation amount in an associated section decreases. Accordingly, by the lowering of the heat generation amount, partly improper fixing can be caused to occur on the image.

As the cause for the generation of the above-described deviation in position relationship between the heat generating element and the electrodes, it is possible to cite an error in accuracy of the screen printing. Therefore, the heater in this embodiment has a constitution in which the electrodes cross the heat generating element with reliability independently of the error in accuracy of the screen printing. That is, in this embodiment, in the heater, the heat generating element and the electrodes are printed on the substrate so that ends (terminals) of the electrodes project from a widthwise end portion of the heat generating element. This will be described in detail using the drawings.

With reference to (a) to (c) of FIG. 12, a manufacturing procedure of a ceramic heater using a thick film printing method (screen printing method) in this embodiment will be described.

In a manufacturing process (step) of, the heater, first, the heat generating element 620 is formed on the substrate 610 (step a) as shown in (a) of FIG. 12). Specifically, the substrate 610 and a plate (mesh plate, metal mask plate) for printing the heat generating element are (positionally) aligned with each other, and thereafter a paste of silver-palladium alloy is applied onto the substrate 610 through the plate. This plate is provided with a passing hole depending on a dimension of the heat generating element, and by passing of the paste through the passing hole, the heat generating element 620 having a desired dimension is printed on the substrate 610. Thereafter, the substrate 610 on which the heat generating element 620 is placed is baked at high temperature.

Then, as shown in (b) of FIG. 12, on the substrate 610 on which the heat generating element 620 is formed, an electroconductor pattern (electrode, electroconductive wire) of a silver paste is formed (step b). Specifically, after alignment between the substrate 610 and a plate for printing the electroconductive lines is made, the silver paste is applied onto the substrate 610 through the plate. This plate is provided with passing holes depending on dimensions of the electrodes 642, 652, 662, the electroconductive lines 640, 650, 660, and the electrical contacts 641, 651, 661, and by passing of the paste through these passing holes, a desired electroconductor pattern is printed on the substrate. That is, a plurality of each of the electrodes 642, 652, 662 are printed. Thereafter, the substrate 610 on which the heat generating element 620 and the electroconductor pattern are placed is baked at high temperature.

Then, as shown in (c) of FIG. 12, on the substrate 610 on which the electroconductor pattern and the heat generating element are placed, an insulating coat layer 680 for effecting electrical, mechanical and chemical protection is formed (step c). Specifically, after alignment between the substrate 610 and a plate for printing glass (coat layer), a glass paste is applied onto the substrate 610 through the plate. This plate is provided with passing holes correspondingly to portions other than the electrical contacts 641, 651, 661, and by passing of the paste through these passing holes, a desired coat layer is printed on the substrate. Thereafter, the substrate 610 on which the heat generating element 620, the electroconductor pattern and the coat layer are placed is backed at high temperature.

In this embodiment, the heat generating element 620 is formed on the substrate 610, and thereafter the electrodes 642, 652, 662 are formed on the heat generating element 620, but a manufacturing method of the heater is not limited thereto. For example, the electrodes 642, 652, 662 arranged with gaps in the longitudinal direction of the substrate are formed, and thereafter the heat generating element 620 may also be formed on the electrodes. That is, the electrode layer may be laminated on the heat generating layer, and the heat generating layer may be laminated on the electrode layer. In other words, the heat generating layer and the electrode layer may only be required to satisfy a mutually laminating relationship, i.e., a mutually overlapping positional relation so as to permit the energization to the heat generation layer.

Incidentally, as in this embodiment, in the case where the heat generating element and the electroconductor pattern are subjected to the screen printing in different steps using different plates, the following problem can arise. That is, the problem is such that the positional relation between the heat generating element and the electrodes can cause a deviation depending on accuracy of the alignment of the substrate 610 with each of the plates.

In this embodiment, the accuracy of the alignment of the substrate 610 with the plate for printing the heat generating element is ±50 μm, and the accuracy of the alignment of the substrate 610 with the plate for printing the electroconductive line is ±50 μm. For that reason, the positional relation between the heat generating element 620 and the electrodes can cause a deviation of 100 μm at the maximum. According to study by the present inventor, in the case where heaters 600 in this embodiment are manufactured, 90% of the heaters 600 causes a deviation of less than 50 μm, and 10% of the heaters 600 causes a deviation of not less than 50 μm. The heaters 600 causing the deviation of not less than 50 μm between the heat generating element 620 and the electrodes is easily checked by visual observation. For that reason, the heater 600 may desirably constituted so as to permit the deviation of less than 50 ρm between the heat generating element and the electrodes and may further desirably constituted so as to permit the deviation of less than 100 μm.

Therefore, in this embodiment, in order that each of the electrodes can cross the heat generating element with reliability independently of the error in accuracy of the screen printing, the printing of the heat generating element and the electrodes is made so that the ends of the electrodes project from the heat generating element in the widthwise direction of the substrate. That is, the printing is made so that the end of the electrode 642 projects from the heat generating element 620 toward the other end portion side 610*e* of the substrate. Further, the printing is made so that the ends of the electrodes 652, 662 project from the heat generating element toward the one end portion side 610*d* of the substrate. By employing such a constitution, each electrode crosses the heat generating element 620 with reliability, and therefore electric power supply to each of the portions of the heat generating element 620 is stabilized. Details thereof are as follows.

A part of the opposite electrodes 652, 662 are printed so as the project from the heat generating element 620 toward the one end portion side 610*d* of the substrate. Here, free ends of the projecting portions of the electrodes 652, 662 are simply referred to as the ends. As shown in (a) of FIG. 11, the end of the opposite electrode 662a projects from the heat generating element 620, and a projection length thereof is gap D. The gap D is an interval for permitting the crossing of the electrode through the heat generating element with reliability independently of manufacturing printing deviation or the like. In order to stably manufacture the heater 600, a target value of the gap D may desirably be set at 50 μm or more. In order to further stably manufacture the heater 600, the target value of the gap D may desirably be set at 100 μm or more. Then, with respect to the heater 600 manufactured using the gap D as the target value, whether or not the end of the opposite electrode 662*a* actually projects from the heat generating element 620 may be checked. As a reference of the checking, it may be checked that the projection length of the opposite electrode 662*a* from the heat generating element 620 is not less than a layer thickness (10 μm in this embodiment) of the opposite electrode 662*a*. When the projection length of the opposite electrode 662*a* is unnecessarily long, a widthwise length of the substrate 610 is enlarged, so that there is a liability that an increase in cost of the heater 600 is caused. For that reason, it is desirable that the projection length of the opposite electrode 662*a* from the heat generating element 620 is not excessively long. The projecting portion of the opposite electrode 662*a* is used for the purpose of compensating for the shortage of a contact length of the opposite electrode 662*a* with the heat generating element 620. For that reason, it would be considered that the length of the projecting portion of the opposite electrode 662*a* is sufficient when the length is equal to the widthwise length of the heat generating element 620 to the maximum. Accordingly, the projection length of the opposite electrode 662*a* may desirably be shorter than a widthwise width Y of the heat generating element 620. That is, the gap D may desirably be less than the widthwise width Y (less than 2000 μm in this embodiment) of the heat generating element 620. In the above description of the gap D, the opposite electrode 662*a* is taken as an instance, but as the projection lengths gap D of all of the opposite electrodes 652, 662, a similar target value may desirably be set.

A part of the common electrodes 642 is printed so as the project from the heat generating element 620 toward the other end portion side 610*e* of the substrate. Here, a free end of the projecting portion of the electrode 642 is simply referred to as the ends. As shown in (a) of FIG. 11, the end of the common electrode 642*a* projects from the heat generating element 620, and a projection length thereof is gap B. The gap B is an interval for permitting the crossing of the electrode through the heat generating element with reliability independently of manufacturing printing deviation or the like. In order to stably manufacture the heater 600, a target value of the gap B may desirably be set at 50 μm or more. In order to further stably manufacture the heater 600, the target value of the gap B may desirably be set at 100 μm or more. Then, with respect to the heater 600 manufactured using the gap B as the target value, whether or not the end of the common electrode 642*a* actually projects from the heat generating element 620 may be checked. As a reference of the checking, it may be checked that the projection length of the common electrode 642*a* from the heat generating element 620 is not less than a layer thickness (10 μm in this embodiment) of the common electrode 642*a*. When the projection length of the common electrode 642*a* is unnecessarily long, a widthwise length of the substrate 610 is enlarged, so that there is a liability that an increase in cost of the heater 600 is caused. For that reason, it is desirable that the projection length of the common electrode 642*a* from the heat generating element 620 is not excessively long. The projecting portion of the common electrode 642*a* is used for the purpose of compensating for the shortage of a contact length of the common electrode 642*a* with the heat generating element 620. For that reason, it would be considered that the length of the projecting portion of the common electrode 642*a* is sufficient when the length is equal to the widthwise length of the heat generating element 620 to the maximum. Accordingly, the projection length of the common electrode 642*a* may desirably be shorter than a widthwise width Y of the heat generating element 620. That is, the gap B may desirably be less than the widthwise width Y (less than 2000 μm in this embodiment) of the heat generating element 620.

In the above description of the gap B, the common electrode 642*a* is taken as an instance, but as the projection lengths gap B of all of the common electrodes 642, a similar target value may desirably be set.

From the above description, the following relationship holds between the heat generating element 620 and the electrodes. That is, as shown in FIG. 11, with respect to the widthwise direction of the substrate, a distance Z between the free end of the electrode 642*a* and the free end of the electrode 662*a* is larger than the heat generating element width Y. It can be said that this relationship is similarly true for the relationship between the plate for printing the heat generating element and the plate for printing the electrodes. That is, as shown in FIG. 13, at the passing portion of the plate for printing the electroconductive lines, a widthwise distance between the position corresponding to the free end of the opposite electrode 652 or 662 and the position corresponding to the free end of the common electrode 642 is taken as Z2. At this time, the distance Z2 is longer than a widthwise length Y2 of the passing portion of the plate for printing the heat generating element.

The common electroconductive line 640 connecting the common electrode 642 and the electrical contact 641*a* extends along the longitudinal direction of the substrate 610. The opposite electroconductive line 650 connecting the opposite electrode 652 and the electrical contacts 651*a*, 651*b* extends along the longitudinal direction of the substrate. The opposite electroconductive line 660 connecting the opposite electrode 662*a* and the electrical contact 661*a* extends along the longitudinal direction of the substrate. That is, in the central region 610*c* of the substrate 610, the electroconductive lines 640, 650, 660 and the heat generating element 620 are disposed substantially in parallel with each other. The term "substantially in parallel" means not only a completely parallel state but also a parallel state within a range of permitting an error in accuracy of the formation of the electroconductive line.

In this embodiment, in the one end portion side 610*d* of the substrate 610, the common electroconductive line 640 is provided at a position of about 400 μm spaced from the opposite electrode (e.g., the electrode 662*a*) with respect to the widthwise direction of the substrate 610. That is, a gap A of about 400 μm in width is provided between the common electroconductive line 640 and the opposite electrode. The gap A is an interval (width) for reliably insulating between the common electrode 640 and the opposite electrode, and is designed so that a minimum value is about 400 μm when the insulating coat layer 680 is provided. The common electroconductive line 640 and the opposite electrode (e.g., the electrode 662*a*) are connected with the different voltage source terminals (110*a*, 110*b*), and therefore the interval of at least 300 μm is required, but in this embodiment, the value of the gap A is a safety value. For that reason, not only the interval of each of the above-described opposite electrode 662*a* and common electroconductive line 640 is required to be about 400 μm but also the interval of each of all of the opposite electrodes 652, 662 and the electroconductive line 640 may desirably be about 400 μm.

In this embodiment, the opposite electroconductive lines 660*a*, 660*b* are provided at positions of about 400 μm spaced from the common electrodes 642*a*, 642*g*, respectively, with respect to the widthwise direction of the substrate 610. That is, a gap C of about 400 μm in width is provided between the common electrode 642 and the opposite electroconductive line 660. The gap C is an interval (width) for reliably insulating between the opposite electroconductive line 660 and the common electrode (e.g., 642*a*) and is designed so that a minimum value is about 400 μm when the insulating coat layer 680 is provided. The opposite electroconductive line 660 and the common electrode (e.g., 642*a*) are connected with the different voltage source terminals (110*a*, 110*b*), and therefore the interval of at least 300 μm is required, but in this embodiment, the value of the gap C is a safety value. As the gap C, not only the interval of the above-described common electrode 642*a* and opposite electroconductive line 660*a* is required to be about 400 μm but also the interval of common electrode 642*g* and the opposite electroconductive line 660*b* may desirably be about 400 μm. Further, the interval between each of the common electrodes 642 and the opposite electroconductive line 650 may desirably be 400 μm or more.

Here, the length of the electrode 642*a* between the electroconductive line 640 and the heat generating element 620 is equal to (gap A)+(gap D), and thus is larger than the gap D. The length of the electrode 662*a* between the electroconductive line 660 and the heat generating element 620 is equal to (gap B)+(gap E), and thus is larger than the gap B. The length of the electrode 652*a* between the electroconductive line 650 and the heat generating element 620 is equal to (gap B)+(gap E), and thus is larger than the gap B.

In this embodiment, the opposite electroconductive line 650 is provided at a position of about 100 μm spaced from the opposite electroconductive lines 660*a*, 660*b* with respect to the widthwise direction of the substrate 610. That is, the gap E of about 100 μm in width is provided between the opposite electroconductive line 650 and each of the opposite electroconductive lines 660*a*, 660*b*. The gap E is the interval which can generate in view of accuracy of formation of the electroconductive lines to be disposed as separate opposite electroconductive lines 660 and 650. The opposite electroconductive lines 660 and 650 are connected with the same voltage source terminal side, and therefore the value of the gap E can be set at a small value. Correspondingly to the decrease in gap E, the widthwise length of the substrate 610 can be made small.

From the above, the length required for the electrode 642 is as follows. That is, the length of the electrode 642 is (gap B)+(Y)+(gap D)+(gap A), and is 2500 μm in this embodiment. Accordingly, with respect to the widthwise direction of the substrate, the width of the heat generating element 2 mm, whereas the length of the electrode 642*a* is 2500 μm. Similarly, the length of the electrode 662 is 2500 μm, and the length of the electrode 652 is 2700 μm. These lengths are 100 μm longer than those in the case where the electrode ends are not projected from the heat generating element. This is similarly true for the plate for printing the heat generating element 620 and the plate for printing the electrodes. That is, in the plate for printing the heat generating element, the widthwise length of the passing portion corresponding to the heat generating element 620 is 2000 μm. Further, in the plate for printing the electroconductive lines, the length of the passing portion corresponding to each of the electrodes 642, 662 is 2500 μm, and the length of the passing portion corresponding to the electrode 652 is 2700 μm.

As described above, in wiring method as in this embodiment, each of the common electrode 642 and the opposite electrodes 652, 662 can cross the heat generating element 620 with reliability. That is, a relationship of: (gap B)>0 ((gap D)>0) is satisfied, so that it is possible to stably provide a heater having a desired resistance distribution independently of a manufacturing error such as printing deviation.

Further, as in this embodiment, in the case where the electrodes are formed on the heat generating element 620, there is an advantage as described below. That is, as shown in (b) of FIG. 11 taken along A-A line in (a) of FIG. 11, the electrodes can be formed so as to contact widthwise side surfaces and an upper surface of the heat generating element 620. That is, a contact area between the heat generating element and the electrodes is large, so that it is possible to effect stable energization. A manner of contact of each of the electrodes with the heat generating element with respect to the widthwise direction of the heat generating element is symmetrical with that for the adjacent electrode with respect to the widthwise direction, and therefore non-uniformity of energization to the heat generating element is suppressed. At this time, the projecting portion of each electrode projects from the heat generating element 620 in the widthwise direction by at least an amount (10 μm in this embodiment) corresponding to the electrode layer thickness.

In this embodiment, the problem relating to the printing deviation in the widthwise direction of the substrate was described, but the printing manner may also be devised so as to obviate the deviation in the longitudinal direction of the substrate. For example, the printing is made so that the longitudinal length of the heat generating element falls within 320 mm±100 μm, so that longitudinal end portions of the electrodes 642*a*, 642*g* may also be positioned outside the heat generating element 620 with respect to the longitudinal direction. By employing such a constitution of the heater 600, it is possible to prevent improper energization at the longitudinal end portions of the heat generating element independently of the accuracy of the screen printing.

(Other Embodiments)

The present invention is not restricted to the specific dimensions in the foregoing embodiments. The dimensions may be changed properly by one skilled in the art depending on the situations. The embodiments may be modified in the concept of the present invention.

The heat generating region of the heater 600 is not limited to the above-described examples which are based on the sheets P are fed with the center thereof aligned with the center of the fixing device 40, but the sheets P may also be supplied on another sheet feeding basis of the fixing device 40. For that reason, e.g., in the case where the sheet feeding basis is an end(-line) feeding basis, the heat generating regions of the heater 600 may be modified so as to meet the case in which the sheets are supplied with one end thereof aligned with an end of the fixing device. More particularly, the heat generating elements corresponding to the heat generating region A are not heat generating elements 620*c*-620*j* but are heat generating elements 620*a*-620*e*. With such an arrangement, when the heat generating region is switched from that for a small size sheet to that for a large size sheet, the heat generating region does not expand at both of the opposite end portions, but expands at one of the opposite end portions.

The number of patterns of the heat generating region of the heater 600 is not limited to two. For example, three or more patterns may be provided.

The forming method of the heat generating element 620 is not limited to those disclosed in Embodiment. In Embodiment, the common electrode 642 and in the opposite electrodes 652, 662 are laminated on the heat generating element 620 extending in the longitudinal direction of the substrate 610. However, the electrodes are formed in the form of an array extending in the longitudinal direction of the substrate 610, and the heat generating elements 620*a*-620*l* may be formed between the adjacent electrodes.

The number of the electrical contacts limited to three or four. For example, five or more electrical contacts may also be provided depending on the number of heat generating patterns required for the fixing device.

Further, in Embodiment, by the constitution in which the electrical contacts are disposed in both longitudinal end portion sides of the substrate 610, the electric power is supplied from the both longitudinal end portion sides to the heater 600, but the fixing device 40 of the present invention is not limited to such a constitution. For example, a fixing device 40 having a constitution in which all of the electrical contacts are disposed in one longitudinal end portion side of the substrate 610 and then the electric power is supplied to the heater 600 from the one longitudinal end portion side may also be used.

The belt 603 is not limited to that supported by the heater 600 at the inner surface thereof and driven by the roller 70. For example, so-called belt unit type in which the belt is extended around a plurality of rollers and is driven by one of the rollers. However, the structures of Embodiment are preferable from the standpoint of low thermal capacity.

The member cooperative with the belt 603 to form of the nip N is not limited to the roller member such as a roller 70. For example, it may be a so-called pressing belt unit including a belt extended around a plurality of rollers.

The image forming apparatus which has been a printer 1 is not limited to that capable of forming a full-color, but it may be a monochromatic image forming apparatus. The image forming apparatus may be a copying machine, a facsimile machine, a multifunction machine having the function of them, or the like, for example, which are prepared by adding necessary device, equipment and casing structure.

The image heating apparatus is not limited to the apparatus for fixing a toner image on a sheet P. It may be a device for fixing a semi-fixed toner image into a completely fixed image, or a device for heating an already fixed image. Therefore, the image heating apparatus may be a surface heating apparatus for adjusting a glossiness and/or surface property of the image, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-183709 filed on Sep. 9, 2014, which is hereby incorporated by reference herein in its entirety.

What is claimed is:

1. A heater connectable with an electric power supply portion having a first terminal and a plurality of second terminals, said heater comprising:

an elongate substrate;

a first set of electrical contacts provided on said substrate and electrically connectable with the first terminal;

a plurality of second sets of electrical contacts provided on said substrate and electrically connectable with the plurality of second terminals;

a plurality of electrodes including a plurality of first electrodes electrically connected with the first set of electrical contacts, and a plurality of second electrodes electrically connected with either one of said second sets of electrical contacts, wherein said first electrodes and said second electrodes are arranged alternately with predetermined gaps in a longitudinal direction of said substrate; and a heat generating layer provided on said plurality of electrodes and configured to generate heat in an area between adjacent first and second electrodes by electric power supplied between said adjacent first and second electrodes, wherein a distance in a widthwise direction perpendicular to the longitudinal direction between terminal ends of said adjacent first and second electrodes is greater than the width of said heat generating layer in the widthwise direction perpendicular to the longitudinal direction.

2. A heater according to claim 1, wherein said first electrodes are projected beyond one end of said heat generating layer in the widthwise direction, and said second electrodes are projected beyond the other end of said heat generating layer in the widthwise direction.

3. A heater according to claim 2, wherein said first electrodes are projected beyond the one end of said heat generating layer at least by the thickness of said heat generating layer in the widthwise direction, and said second electrodes are projected beyond the other end of said heat generating layer at least by the thickness of said heat generating layer in the widthwise direction.

4. A heater according to claim 1, further comprising:

a first electroconductive line provided on said substrate along the longitudinal direction and configured to electrically connect said first set of electrical contacts and said first electrodes;

a second electroconductive line provided on said substrate along the longitudinal direction and configured to electrically connect one of said second sets of electrical contacts and a part of said second electrodes; and a third electroconductive line provided on said substrate along the longitudinal direction and configured to electrically connect another one of said second sets of electrical contacts and another part of said second electrodes.

5. A heater connectable with an electric power supply portion having a first terminal and a plurality of second terminals, said heater comprising:

an elongate substrate;

a first set of electrical contacts provided on said substrate and electrically connectable with the first terminal;

a plurality of second sets of electrical contacts provided on said substrate and electrically connectable with the plurality of second terminals;

a plurality of electrodes including a plurality of first electrodes electrically connected with said first set of electrical contacts and a plurality of second electrodes electrically connected with either one of said second sets of electrical contacts, wherein said first electrodes and said second electrodes are arranged alternately with predetermined gaps in a longitudinal direction of said substrate; and a heat generating layer provided on said plurality of said electrodes and configured to generate heat in an area between adjacent first and second electrodes by electric power supplied between said adjacent first and second electrodes, wherein terminal ends of said first electrodes are projected beyond one end of said heat generating layer in a width direction perpendicular to the longitudinal direction, and terminal ends of said second electrodes are projected beyond the other end of said heat generating layer in the width direction.

6. A heater according to claim 5, wherein said first electrodes are projected beyond the one end of said heat generating layer at least by the thickness of said heat generating layer in the widthwise direction, and said second electrodes are projected beyond the other end of said heat generating layer at least by the thickness of said heat generating layer in the widthwise direction.

7. A heater according to claim 5, further comprising:

a first electroconductive line provided on said substrate along the longitudinal direction and configured to electrically connect said first set of electrical contacts and said first electrodes;

a second electroconductive line provided on said substrate along the longitudinal direction and configured to electrically connect one of said second sets of electrical contacts and a part of said second electrodes; and a third electroconductive line provided on said substrate along the longitudinal direction and configured to electrically connect another one of said second sets of electrical contacts and another part of said second electrodes.

8. An image heating apparatus comprising:

(i) an electric energy supplying portion provided with a first terminal and a plurality of second terminals;

(ii) a rotatable member configured to heat an image on a sheet; and (iii) a heater configured to heat said rotatable member, said heater including:

(iii-i) an elongate substrate;

(iii-ii) a first set of electrical contacts provided on said substrate and electrically connectable with said first terminal;

(iii-iii) a plurality of second sets of electrical contacts provided on said substrate and electrically connectable with said plurality of second terminals;

(iii-iv) a plurality of electrodes including a plurality of first electrodes electrically connected with said first set of electrical contacts, and a plurality of second electrodes electrically connected with either one of said second sets of electrical contacts, wherein said first electrodes and said second electrodes are arranged alternately with predetermined gaps in a longitudinal direction of said substrate;

(iii-v) a heat generating layer provided on said plurality of said electrodes and configured to generate heat in an area between adjacent first and second electrodes by electric power supplied between said adjacent first and second electrodes;

(iii-vi) a first electroconductive line extending in a longitudinal direction and electrically connected with said first set of electrical contacts and said first electrodes;

(iii-vii) a second electroconductive line extending in the longitudinal direction and electrically connected with one of said second sets of electrical contacts and a part of said second electrodes; and (iii-viii) a third electroconductive line extending in the longitudinal direction and electrically connected with another one of said second sets of electrical contacts and another part of said second electrodes, wherein a distance in a widthwise direction perpendicular to the longitudinal direction between terminal ends of said adjacent first and second electrodes is greater than the width of said heat generating layer in the widthwise direction perpendicular to the longitudinal direction.

9. An apparatus according to claim 8, wherein said first electrodes are projected beyond one end of said heat generating layer in the widthwise direction, and said second electrodes are projected beyond the other end of said heat generating layer in the widthwise direction.

10. An apparatus according to claim 9, wherein said first electrodes are projected beyond the one end of said heat generating layer at least by the thickness of said heat generating layer in the widthwise direction, and said second electrodes are projected beyond the other end of said heat generating layer at least by the thickness of said heat generating layer in the widthwise direction.

11. An image heating apparatus comprising:

(i) an electric energy supplying portion provided with a first terminal and a plurality of second terminals;

(ii) a rotatable member configured to heat an image on a sheet; and (iii) a heater configured to heat said rotatable member, said heater including:

(iii-i) an elongate substrate;

(iii-ii) a first set of electrical contacts provided on said substrate and electrically connectable with said first terminal;

(iii-iii) a plurality of second sets of electrical contacts provided on said substrate and electrically connectable with said plurality of second terminals;

(iii-iv) a plurality of electrodes including a plurality of first electrodes electrically connected with said first set of electrical contacts, and a plurality of second electrodes electrically connected with either one of said second sets of electrical contacts, wherein said first electrodes and said second electrodes are arranged alternately with predetermined gaps in a longitudinal direction of said substrate;

(iii-v) a heat generating layer provided on said plurality of said electrodes and configured to generate heat in an area between adjacent first and second electrodes by electric power supplied between said adjacent first and second electrodes;

(iii-vi) a first electroconductive line extending in a longitudinal direction and electrically connected with said first set of electrical contacts and said first electrodes;

(iii-vii) a second electroconductive line extending in the longitudinal direction and electrically connected with one of said second sets of electrical contacts and a part of said second electrodes; and (iii-viii) a third electroconductive line extending in the longitudinal direction and electrically connected with another one of said second sets of electrical contacts and another part of said second electrodes, wherein terminal ends of said first electrodes are projected beyond one end of said heat generating layer in a width direction perpendicular to the longitudinal direction, and terminal ends of said second electrodes are projected beyond the other end of said heat generating layer in the width direction.

12. An apparatus according to claim 11, wherein said first electrodes are projected beyond the one end of said heat generating layer at least by the thickness of said heat generating layer in the widthwise direction, and said second electrodes are projected beyond the other end of said heat generating layer at least by the thickness of said heat generating layer in the widthwise direction.

* * * * *